US012351416B2

(12) United States Patent
Tohkaishi et al.

(10) Patent No.: US 12,351,416 B2
(45) Date of Patent: Jul. 8, 2025

(54) MEDIUM PROCESSING APPARATUS AND IMAGE FORMING SYSTEM

(71) Applicants: Shuuto Tohkaishi, Kanagawa (JP); Yuusuke Shibasaki, Tokyo (JP); Yusuke Hirono, Kanagawa (JP); Atsushi Shinoda, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(72) Inventors: Shuuto Tohkaishi, Kanagawa (JP); Yuusuke Shibasaki, Tokyo (JP); Yusuke Hirono, Kanagawa (JP); Atsushi Shinoda, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 18/582,543

(22) Filed: Feb. 20, 2024

(65) Prior Publication Data

US 2024/0300771 A1 Sep. 12, 2024

(30) Foreign Application Priority Data

Mar. 10, 2023 (JP) ..... 2023-037826

(51) Int. Cl.
*B65H 37/04* (2006.01)
*B65H 5/00* (2006.01)
*B65H 9/04* (2006.01)

(52) U.S. Cl.
CPC ..... *B65H 37/04* (2013.01); *B65H 5/006* (2013.01); *B65H 9/04* (2013.01);
(Continued)

(58) Field of Classification Search
CPC ..... G03G 15/6514; G03G 15/6582; B65H 37/04; B65H 9/04; B65H 9/20;
(Continued)

(56) References Cited

U.S. PATENT DOCUMENTS 8,226,079 B2 * 7/2012 Ozawa ..... B65H 31/34 270/58.08
9,505,581 B2 * 11/2016 Kai ..... B65H 43/00
(Continued)

FOREIGN PATENT DOCUMENTS

EP 2889248 A2 7/2015
EP 3923079 A2 12/2021
(Continued)

OTHER PUBLICATIONS

Espacenet machine translation of JP2019181733A; https://translationportal.epo.org/emtp/translate/?ACTION=description-retrieval&COUNTRY=JP&ENGINE=google&FORMAT=docdb&KIND=A&LOCALE=en_EP&NUMBER=2019181733&OPS=ops.epo.org/3.2&SRCLANG=ja&TRGLANG=en (Year: 2019).*
(Continued)

*Primary Examiner* — Leslie A Nicholson, III
(74) *Attorney, Agent, or Firm* — Duft & Bornsen, PC

(57) ABSTRACT

A medium processing apparatus for processing a medium ejected from an image forming apparatus includes a conveyor, a slit, a medium processing device, a stopper, and detectors. The conveyor conveys the medium ejected from the image forming apparatus. The slit communicates with an opening of a housing into which a medium is manually inserted from outside and includes a placement face on which the inserted medium is placed. The placement face has a first side and a second side orthogonal to the first side. The first and second sides are not parallel to a direction in
(Continued)

which a side face of the housing extends. The medium processing device processes the medium conveyed by the conveyor or the medium placed on the slit. The stopper regulates edges of the medium along the first and second sides of the placement face. The detectors are disposed on the stopper to detect the medium.

20 Claims, 17 Drawing Sheets

(52) U.S. Cl.
CPC ..... *B65H 2301/51611* (2013.01); *B65H 2402/35* (2013.01); *B65H 2511/51* (2013.01); *B65H 2801/06* (2013.01); *B65H 2801/24* (2013.01)

(58) Field of Classification Search
CPC ..... B65H 2301/51611; B65H 2402/35; B65H 31/34; B65H 2801/24; B65H 2801/27
USPC ..... 270/58.08, 58.09
See application file for complete search history.

(56) References Cited

U.S. PATENT DOCUMENTS

| | | | | |
|---|---|---|---|---|
| 9,586,429 | B2 * | 3/2017 | Nakagomi | B42C 1/12 |
| 9,776,449 | B2 * | 10/2017 | Shimura | B42C 1/12 |
| 11,027,567 | B2 * | 6/2021 | Sugiyama | B42C 1/12 |
| 2015/0360899 | A1 | 12/2015 | Takahashi et al. | |
| 2016/0060072 | A1 | 3/2016 | Watanabe et al. | |
| 2016/0068359 | A1 | 3/2016 | Suzuki et al. | |
| 2016/0114999 | A1 | 4/2016 | Suzuki et al. | |
| 2016/0221787 | A1 | 8/2016 | Matsushita et al. | |
| 2016/0340144 | A1 | 11/2016 | Sakano et al. | |
| 2016/0340145 | A1 | 11/2016 | Kunieda et al. | |
| 2016/0360053 | A1 | 12/2016 | Suzuki et al. | |
| 2017/0174465 | A1 | 6/2017 | Morinaga et al. | |
| 2017/0217239 | A1 | 8/2017 | Suzuki et al. | |
| 2018/0259895 | A1 | 9/2018 | Shibasaki et al. | |
| 2019/0276263 | A1 | 9/2019 | Hidaka et al. | |
| 2019/0284006 | A1 | 9/2019 | Hoshino et al. | |
| 2019/0284008 | A1 | 9/2019 | Sakano et al. | |
| 2019/0284009 | A1 | 9/2019 | Suzuki et al. | |
| 2019/0284010 | A1 | 9/2019 | Asami et al. | |
| 2019/0284011 | A1 | 9/2019 | Furuhashi et al. | |
| 2019/0284012 | A1 | 9/2019 | Yoneyama et al. | |
| 2019/0367317 | A1 | 12/2019 | Haraguchi et al. | |
| 2020/0103811 | A1 | 4/2020 | Sugiyama et al. | |
| 2020/0239265 | A1 | 7/2020 | Suzuki et al. | |
| 2020/0307936 | A1 | 10/2020 | Sugawara et al. | |
| 2020/0307944 | A1 | 10/2020 | Shibasaki et al. | |
| 2020/0385231 | A1 | 12/2020 | Kunieda et al. | |
| 2020/0407187 | A1 | 12/2020 | Hidaka et al. | |
| 2021/0039900 | A1 | 2/2021 | Shimazu et al. | |
| 2021/0316955 | A1 | 10/2021 | Shibasaki et al. | |
| 2021/0347589 | A1 | 11/2021 | Suzuki et al. | |
| 2021/0403273 | A1 | 12/2021 | Haraguchi et al. | |
| 2022/0055855 | A1 | 2/2022 | Shinoda et al. | |
| 2022/0289512 | A1 | 9/2022 | Takahashi et al. | |
| 2022/0334523 | A1 | 10/2022 | Akiyama et al. | |
| 2022/0363088 | A1 | 11/2022 | Yoshizawa et al. | |
| 2022/0380166 | A1 | 12/2022 | Nozaki et al. | |
| 2023/0001731 | A1 | 1/2023 | Haraguchi et al. | |
| 2023/0331029 | A1 | 10/2023 | Suzuki et al. | |
| 2023/0331507 | A1 | 10/2023 | Ota et al. | |
| 2023/0391568 | A1 | 12/2023 | Nozaki | |

FOREIGN PATENT DOCUMENTS

| | | | |
|---|---|---|---|
| JP | 2005096392 | A | 4/2005 |
| JP | 2015-016971 | A | 1/2015 |
| JP | 2019-181733 | A | 10/2019 |
| JP | 2020-050494 | A | 4/2020 |

OTHER PUBLICATIONS

European Search Report; Application EP24160408.1; Jul. 25, 2024.

* cited by examiner

FIG. 16A

MANUAL STAPLING

WARNING: MANUAL STAPLING IS CURRENTLY UNAVAILABLE.
PLEASE WAIT X MORE SECONDS FOR NEXT MANUAL STAPLING.

FIG. 16B

MANUAL STAPLING

WARNING: SHEET IS NOT CORRECTLY SET.
PLEASE SET SHEET AGAIN.

FIG. 16C

MANUAL STAPLING

PROCESSING: STAPLING IS IN PROGRESS.
DO NOT MOVE SHEET.

MEDIUM PROCESSING APPARATUS AND IMAGE FORMING SYSTEM

CROSS-REFERENCE TO RELATED APPLICATION

This patent application is based on and claims priority pursuant to 35 U.S.C. § 119(a) to Japanese Patent Application No. 2023-037826, filed on Mar. 10, 2023, in the Japan Patent Office, the entire disclosure of which is hereby incorporated by reference herein.

BACKGROUND

Technical Field

Embodiments of the present disclosure relate to a medium processing apparatus and an image forming system incorporating the medium processing apparatus.

Related Art

Medium processing apparatuses have been developed as post-processing apparatuses to perform post-processing such as binding sheets on which images are formed by image forming apparatuses.

Some medium processing apparatuses have a manual processing structure that enables processing by manual operation (manual processing) on a medium such as a sheet of paper manually inserted by a user.

When a medium is processed, the medium is to be placed at an appropriate position.

SUMMARY

According to an embodiment of the present disclosure, a medium processing apparatus for processing a medium ejected from an image forming apparatus includes a conveyor, a slit, a medium processing device, a stopper, and a plurality of detectors. The conveyor conveys the medium ejected from the image forming apparatus. The slit communicates with an opening of a housing into which a medium is manually inserted from outside. The slit includes a placement face on which the inserted medium is placed. The placement face has a first side and a second side orthogonal to the first side. The first side and the second side are not parallel to a direction in which a side face of the housing extends. The medium processing device processes the medium conveyed by the conveyor or the medium placed on the slit. The stopper regulates edges of the medium along the first side and the second side of the placement face. The plurality of detectors is disposed on the stopper to detect the medium.

According to an embodiment of the present disclosure, an image forming system includes an image forming apparatus that forms an image on a medium and the medium processing apparatus that performs post-processing on the medium on which the image is formed by the image forming apparatus.

According to an embodiment of the present disclosure, a medium processing apparatus for processing a medium ejected from an image forming apparatus includes a conveyor, a slit, a medium processing device, a stopper, and a plurality of detectors. The conveyor conveys the medium ejected from the image forming apparatus. The slit communicates with an opening of a housing into which a medium is manually inserted from outside. The slit includes a placement face on which the inserted medium is placed. The placement face has a first side and a second side orthogonal to the first side. The first side and the second side are not parallel to a direction in which the conveyor conveys the medium. The medium processing device processes the medium conveyed by the conveyor or the medium placed on the slit. The stopper regulates edges of the medium along the first side and the second side of the placement face. The plurality of detectors is disposed on the stopper to detect the medium.

According to an embodiment of the present disclosure, an image forming system includes an image forming apparatus that forms an image on a medium and the medium processing apparatus that performs post-processing on the medium on which the image is formed by the image forming apparatus.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein:

FIGS. 16A to 16C are diagrams each illustrating a display example on a control panel according to an embodiment of the present disclosure.

Figure 1B:
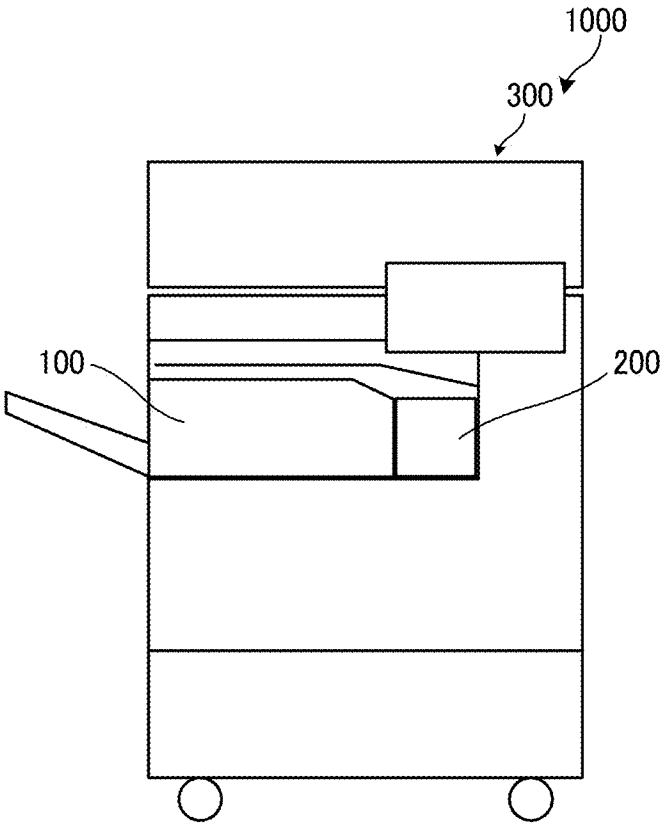
FIGS. 1A and 1B are schematic diagrams each illustrating a configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring to the drawings, embodiments of the present disclosure are described below.

As used herein, the singular forms "a," "an," and "the" are intended to include the plural forms as well, unless the context clearly indicates otherwise.

For the sake of simplicity, like reference signs denote like elements such as parts and materials having the same functions, and redundant descriptions thereof are omitted unless otherwise required.

As used herein, the term "connected/coupled" includes both direct connections and connections in which there are one or more intermediate connecting elements.

Figure 1A:
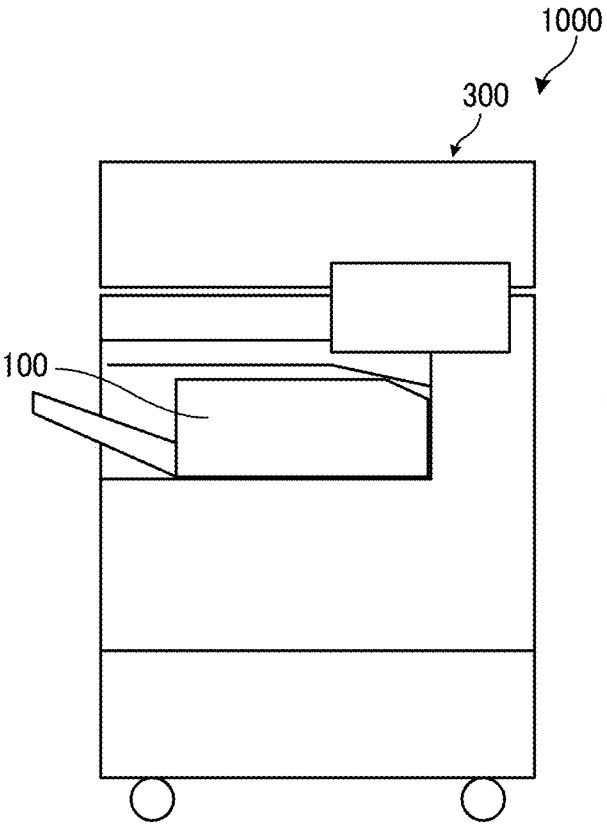

Each of FIGS. 1A and 1B is an external schematic view of an image forming system 1000, which includes a post-processing apparatus 100 as a medium processing apparatus and an image forming apparatus 300 according to the present embodiment.

The image forming apparatus 300 is, for example, an apparatus that forms an image on a medium by an electrophotographic process.

In the following description, a medium to be processed by the image forming apparatus 300, the post-processing apparatus 100, and an optional apparatus 200 is described as a sheet. However, the medium is not limited to a paper medium. Alternatively, for example, the medium may be a plastic sheet, a cloth sheet, or a metal sheet.

FIG. 1A illustrates a configuration of the image forming apparatus 300 equipped with the post-processing apparatus 100 (inner finisher) as the medium processing apparatus, according to the present embodiment. After a sheet is subjected to image forming processing in the image forming apparatus 300 and ejected from the image forming apparatus 300, the sheet is conveyed to the post-processing apparatus 100 and subjected to post-processing such as binding.

FIG. 1B illustrates a configuration of the image forming apparatus 300 equipped with the post-processing apparatus 100 and the optional apparatus 200, according to the present embodiment. After a sheet is subjected to the image forming processing in the image forming apparatus 300 and ejected from the image forming apparatus 300, the sheet is conveyed to the optional apparatus 200 and subjected to post-processing such as punching or folding. The post-processed medium is then conveyed to the post-processing apparatus 100 and subjected to post-processing such as binding. A user can appropriately determine whether to install the optional apparatus 200 in the image forming apparatus 300.

Figure 2B:
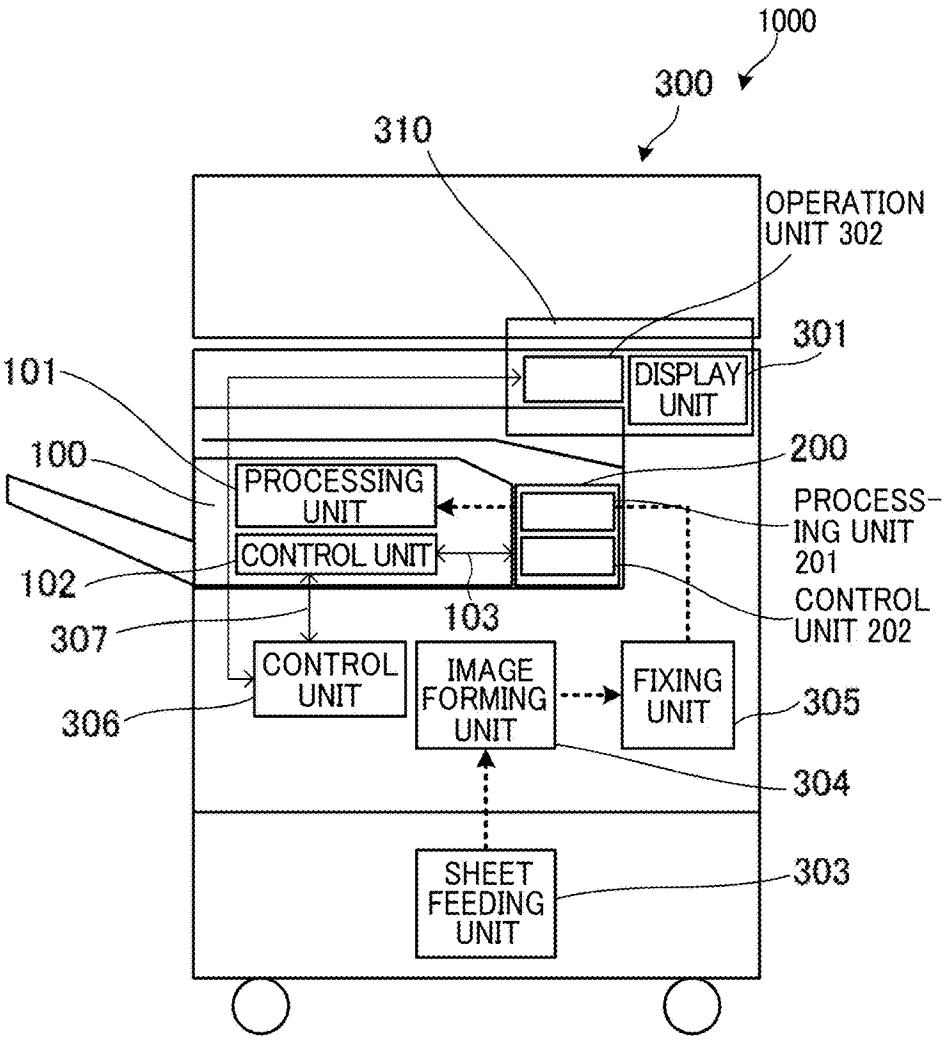
FIG. 2B is a block diagram illustrating the image forming system of FIG. 1B.
Figure 2A:
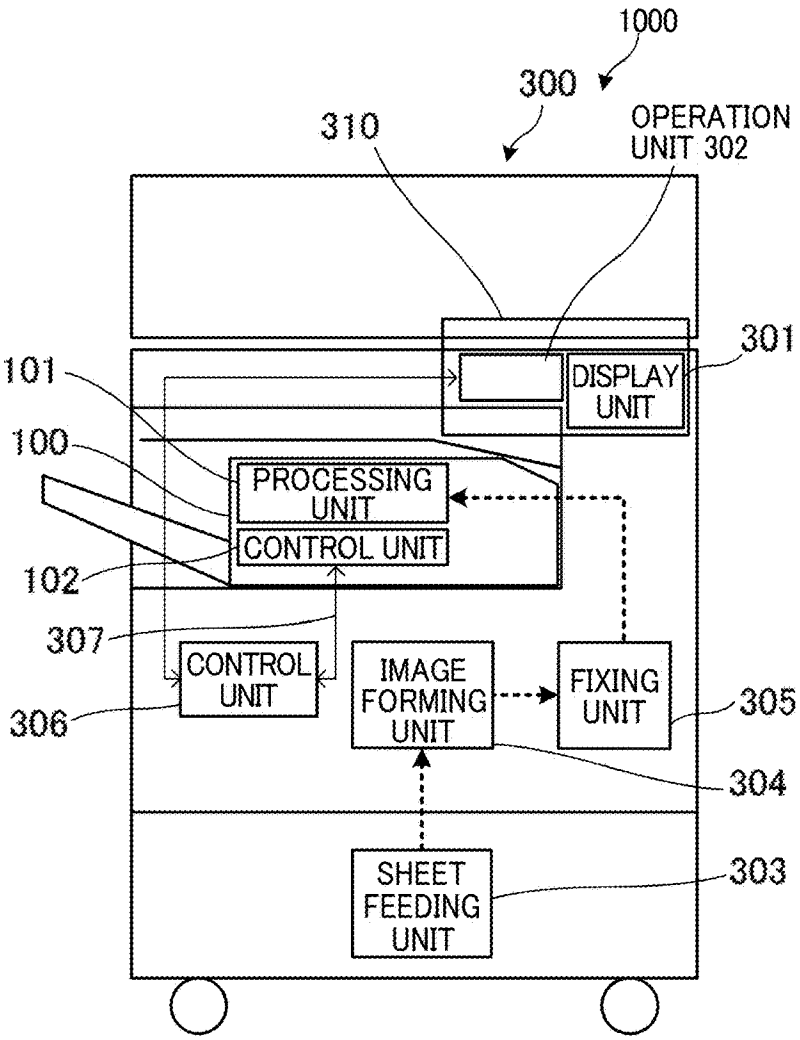
FIG. 2A is a block diagram illustrating the image forming system of FIG. 1A.

Each of FIGS. 2A and 2B is a block diagram of the image forming system 1000, which includes the image forming apparatus 300 and the post-processing apparatus 100 illustrated in FIGS. 1A and 1B, according to the present embodiment. The image forming system 1000 illustrated in FIG. 2A includes the optional apparatus 200 illustrated in FIG. 1B, in addition to the image forming apparatus 300 and the post-processing apparatus 100. In each of FIGS. 2A and 2B, the flow of communication signals is indicated by solid lines, whereas the flow of sheets is indicated by broken lines.

FIG. 2A is a block diagram illustrating the image forming system 1000 of FIG. 1A.

The image forming apparatus 300 includes a display unit 301, an operation unit 302, an operation panel 310, a sheet feeding unit 303, an image forming unit 304, a fixing unit 305, and a control unit 306. The display unit 301 notifies the user of the state of various devices and the operation contents of the apparatus. The operation unit 302 allows the user to set, for example, an operation mode and the number of copies. The sheet feeding unit 303 stocks sheets and feeds the sheets one by one. The image forming unit 304 forms a latent image on a photoconductor and transfers the image onto a sheet. The fixing unit 305 fixes the image transferred onto the sheet. The control unit 306 controls these units.

The post-processing apparatus 100 includes a control unit 102 and a processing unit 101.

The control unit 306 of the image forming apparatus 300 instructs, through a communication line 307, the control unit 102 to cause the processing unit 101 to perform the designated processing on the designated sheet. Examples of information exchanged through the communication line 307 include, but are not limited to, information on the type and mode of processing to be performed on a sheet, information on the size of a sheet, and information on the processing timing. Such a configuration enables the system to operate.

FIG. 2B is a block diagram illustrating the image forming system 1000 of FIG. 1B.

The configurations of the image forming apparatus 300 and the post-processing apparatus 100 are the same as those illustrated in FIG. 2A.

The optional apparatus 200 includes a control unit 202 and a processing unit 201.

The control unit 102 of the post-processing apparatus 100 instructs, through a communication line 103, the control unit 202 to cause the processing unit 201 to perform the designated processing on the designated sheet. Like the information exchanged through the communication line 307, examples of information exchanged through the communication line 103 include, but are not limited to, information on the type and mode of processing to be performed on a sheet, information on the size of a sheet, and information on the processing timing. Such a configuration enables the system to operate.

Figure 3:
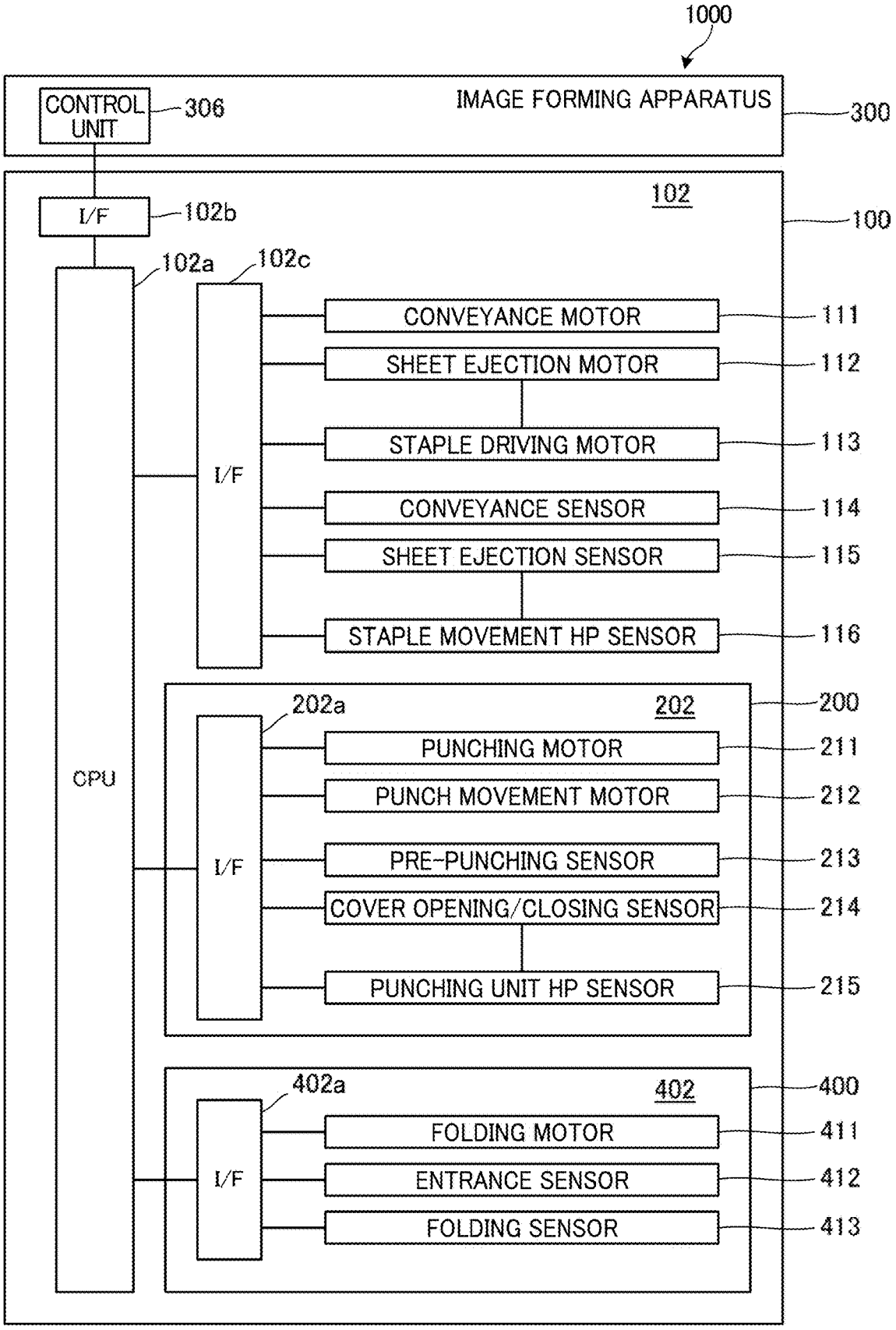
FIG. 3 is a block diagram illustrating a hardware configuration of an image forming system according to an embodiment of the present disclosure.

FIG. 3 is a block diagram illustrating a hardware configuration of the image forming system 1000 according to the present embodiment.

The control unit 102 of the post-processing apparatus 100 is connected to the control unit 306 of the image forming apparatus 300 through an interface (I/F) 102*b*. The post-processing apparatus 100 is controlled according to processing signals from the image forming apparatus 300.

A central processing unit (CPU) 102*a* is processing means to control the entire operation of the post-processing apparatus 100.

The image forming system 1000 illustrated in FIG. 3 includes, as optional apparatuses, the optional apparatus 200 that performs punching and an optional apparatus 400 that performs folding.

The control unit 202 of the optional apparatus 200 is connected to the CPU 102*a* of the post-processing apparatus 100 through an I/F 202*a*. A control unit 402 of the optional apparatus 400 is connected to the CPU 102*a* of the post-processing apparatus 100 through an I/F 402*a*. The control unit 102 of the post-processing apparatus 100 controls the operations of the control unit 202 of the optional apparatus 200 and the control unit 402 of the optional apparatus 400.

The post-processing apparatus 100, the optional apparatus 200, and the optional apparatus 400 are detachable apparatuses. Similarly, the I/F 102*b*, the I/F 202*a*, and the I/F 402*a* are detachable in hardware by, for example, relay connectors or drawer connectors.

The control unit 102 of the post-processing apparatus 100 is connected to a conveyance motor 111, a sheet ejection motor 112, a staple driving motor 113, a conveyance sensor 114, a sheet ejection sensor 115, and a staple movement home position (HP) sensor 116 through an I/F 102*c*.

A punching motor 211, the punch movement motor 212, the pre-punching sensor 213, the cover opening/closing sensor 214, and the punching unit HP sensor 215 of the control unit 202 of the optional apparatus 200 are connected to the CPU 102*a* through the I/F 202*a*.

A folding motor 411, an entrance sensor 412, and a folding sensor 413 of the control unit 402 of the optional apparatus 400 are connected to the CPU 102*a* through the I/F 402*a*. Each of FIGS. 4A, 4B, and 5A to 5F is a diagram illustrating the configuration and operation of a main device 100*a*, which is a body of the post-processing apparatus 100 serving as a medium processing apparatus according to an embodiment of the present disclosure. The main device 100*a* executes post-processing on a sheet ejected from the image forming apparatus 300.

The post-processing apparatus 100 according to the present embodiment is an apparatus that performs binding as post-processing. The post-processing apparatus 100 includes binding means (a binding device) as post-processing means.

Figure 4A:
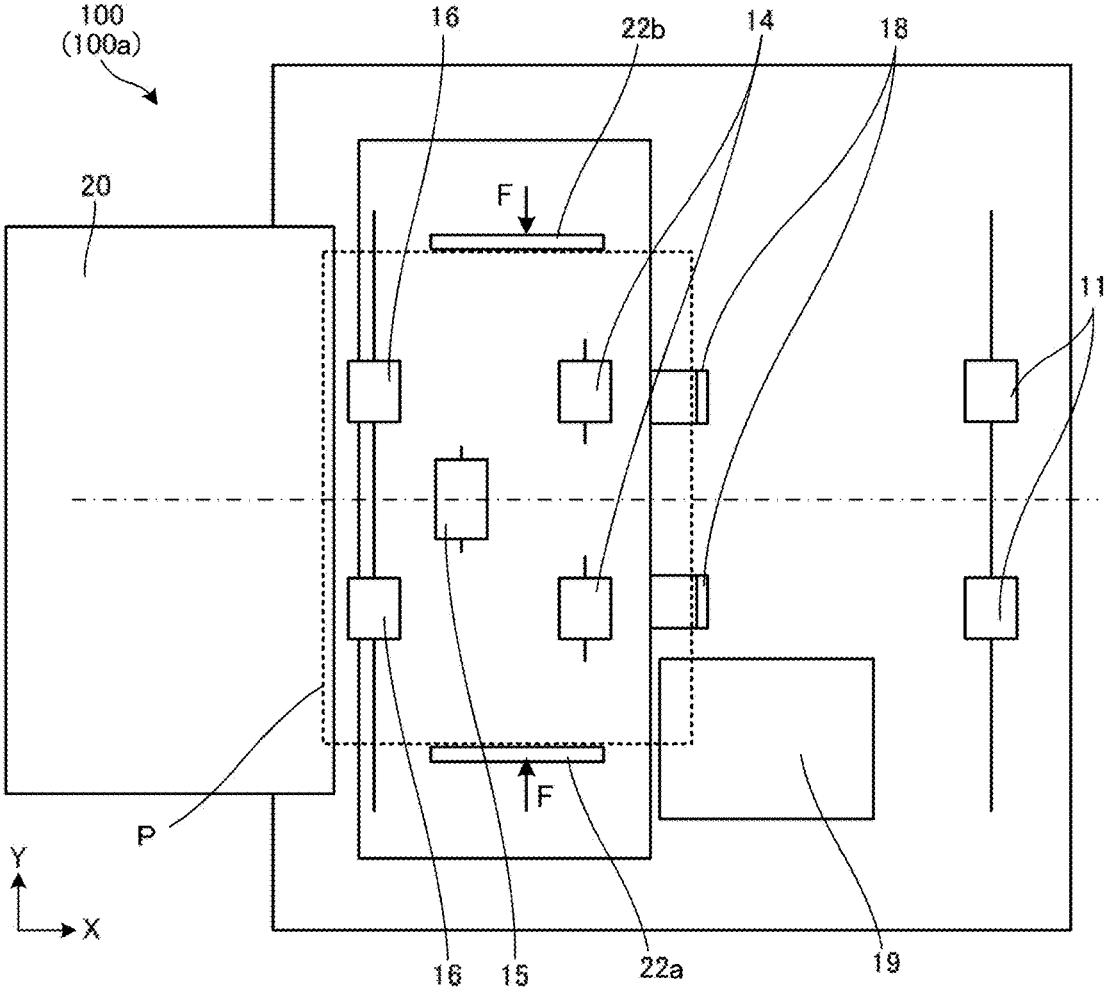
FIG. 4A is a plan view of a medium processing apparatus according to an embodiment of the present disclosure.
Figure 4B:
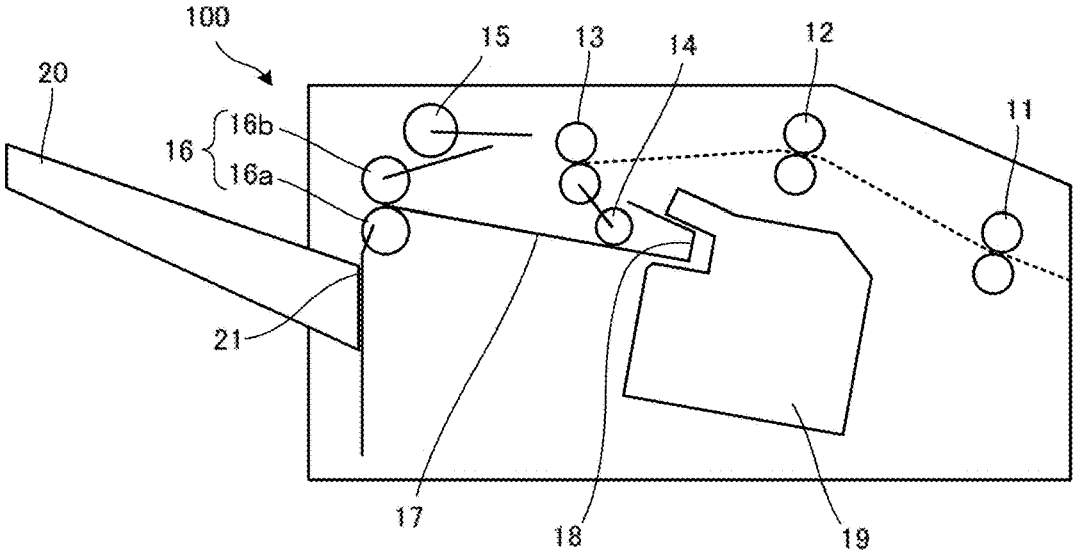
FIG. 4B is a side view of the medium processing apparatus of FIG. 4A.

Specifically, FIG. 4A is a plan view of the post-processing apparatus 100. FIG. 4B is a side view of the post-processing apparatus 100 in a direction Y.

In FIG. 4A, the chain line indicates a reference position (reference line) as the widthwise center of the sheet conveyed in and ejected from the main device 100*a*.

In FIG. 4B, the broken line indicates a sheet conveyance passage along which the sheet is conveyed.

As illustrated in FIGS. 4A and 4B, the post-processing apparatus 100 includes entrance rollers 11, conveyance rollers 12, shift rollers 13, and output rollers 16. The entrance rollers 11 are disposed near an entrance into which the sheet ejected from the image forming apparatus 300 is conveyed. The entrance rollers 11 are located most upstream on the sheet conveyance passage in a sheet conveyance direction in which the sheet is conveyed. The conveyance rollers 12 are located downstream from the entrance rollers 11. The shift rollers 13 shift the sheet in the post-processing apparatus 100 in a direction (width direction) orthogonal to the sheet conveyance direction. The output rollers 16 are disposed near an output tray 20 onto which the sheet is ejected. The output rollers 16 are located most downstream on the sheet conveyance passage in the sheet conveyance direction. The output rollers 16 include pairs of an output driving roller 16*a* and an output driven roller 16*b*.

The post-processing apparatus 100 further includes a reference fence 18 and an end fence 21. The leading end of the sheet in the sheet conveyance direction abuts against the reference fence 18 when the binding is executed. The trailing end of the ejected sheet in a sheet ejection direction in which the sheet is ejected abuts against the end fence 21. The sheets stopped by the reference fence 18 and the end fence 21 are aligned at the edges of the sheets in the sheet conveyance direction.

The post-processing apparatus 100 further includes return rollers 14 and a tapping roller 15. The return rollers 14 convey the sheet toward the reference fence 18 and bring the sheet into contact with the reference fence 18. The tapping roller 15 conveys the sheet toward the reference fence 18.

As illustrated in FIG. 4A, the post-processing apparatus 100 further includes a pair of jogger fences 22 (jogger fences 22*a* and 22*b*) to align the widthwise edges of a sheet P. The pair of jogger fences 22 can be displaced according to the size of the sheet. The jogger fences 22*a* and 22*b* sandwich the sheet P in directions indicated by arrows F in FIG. 4A to align the widthwise edges of the sheet P.

The post-processing apparatus 100 further includes a binding device 19 (stapler) that performs binding and a staple tray 17 on which the sheets are stacked until the sheets are bound.

The post-processing apparatus 100 according to the present embodiment has a "staple mode" and a "shift ejection mode." In the staple mode, the sheets ejected from the image forming apparatus 300 are bound. In the shift ejection mode, the sheets ejected from the image forming apparatus 300 are conveyed and ejected without being subjected to post-processing. The user can select and set one of the modes as appropriate.

In the shift ejection mode, the post-processing apparatus 100 receives and conveys a sheet ejected from the image forming apparatus 300 into the main device 100*a* with the entrance rollers 11. After conveying the sheet to the output rollers 16, the post-processing apparatus 100 ejects the sheet onto the output tray 20.

In the staple mode, the post-processing apparatus 100 receives and conveys the sheet ejected from the image forming apparatus 300 into the main device 100*a* with the entrance roller 11. After conveying the sheet to the shift rollers 13, the post-processing apparatus 100 ejects the sheet onto the staple tray 17. The post-processing apparatus 100 then causes the tapping roller 15 and the return rollers 14 to switch back the sheet to convey the sheet until the sheet end abuts against the reference fence 18. After conveying a plurality of sheets in the aforementioned way, the post-processing apparatus 100 binds the sheets as a sheet bundle with the binding device 19 and ejects the bound sheet bundle onto the output tray 20 by the rotation of the output rollers 16.

Referring to FIGS. 5A to 5F, a description is given below of a process in the staple mode according to the present embodiment.

Each of FIGS. 5A to 5F is a side view of the main device 100*a* of the post-processing apparatus 100 according to the present embodiment. FIGS. 5A to 5F illustrate a post-processing process of a sheet that is conveyed along the sheet conveyance passage after being ejected from the image forming apparatus 300. In each of FIGS. 5A to 5F, the broken line indicates the sheet conveyance passage along which the sheet P is conveyed. Each of arrows D1 and D2 indicates the sheet conveyance direction in which the sheet P is conveyed.

Figure 5A:
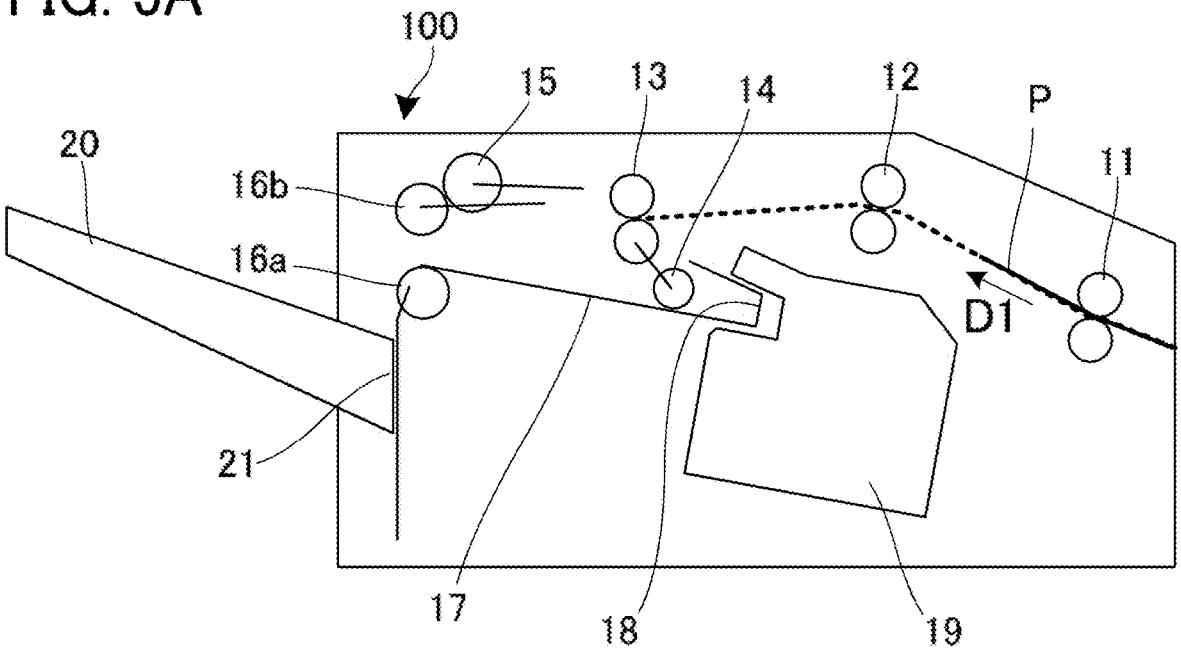
FIGS. 5A to 5F are diagrams illustrating a process performed on a medium ejected from an image forming apparatus, according to an embodiment of the present disclosure.

As illustrated in FIG. 5A, the sheet P ejected from the image forming apparatus 300 is received and conveyed into the post-processing apparatus 100 by the entrance rollers 11.

Figure 5B:
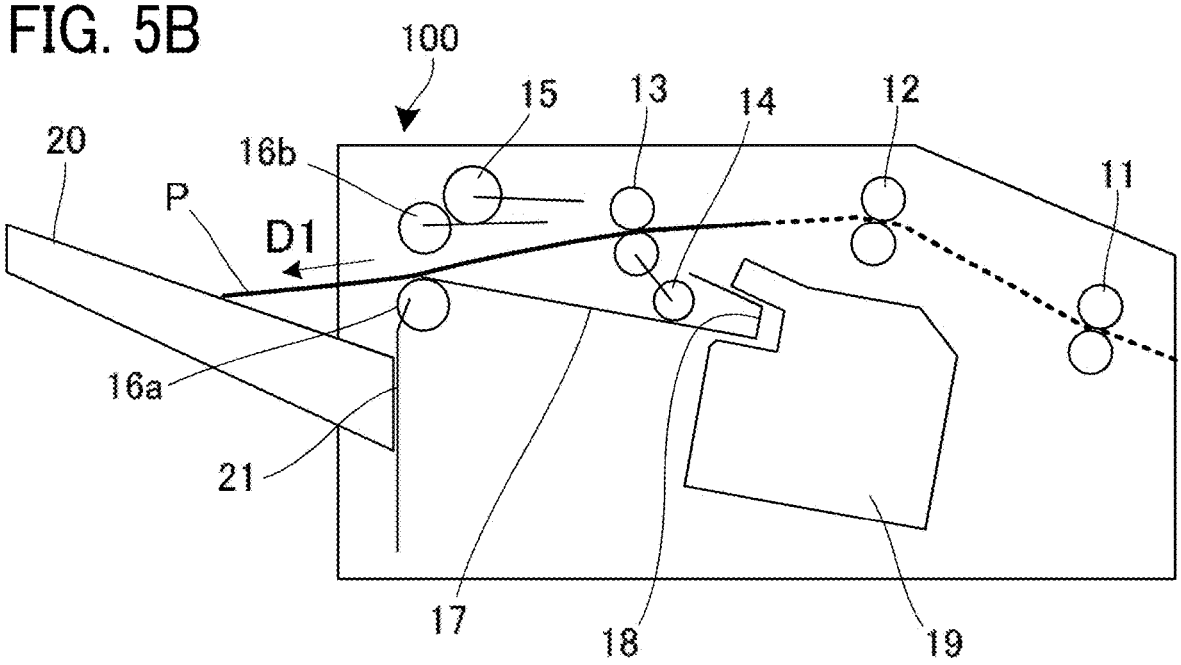

As illustrated in FIG. 5B, the sheet P is conveyed toward the staple tray 17 while the sheet P is not shifted and the output driven roller 16*b* is kept at a pressure release position.

Figure 5C:
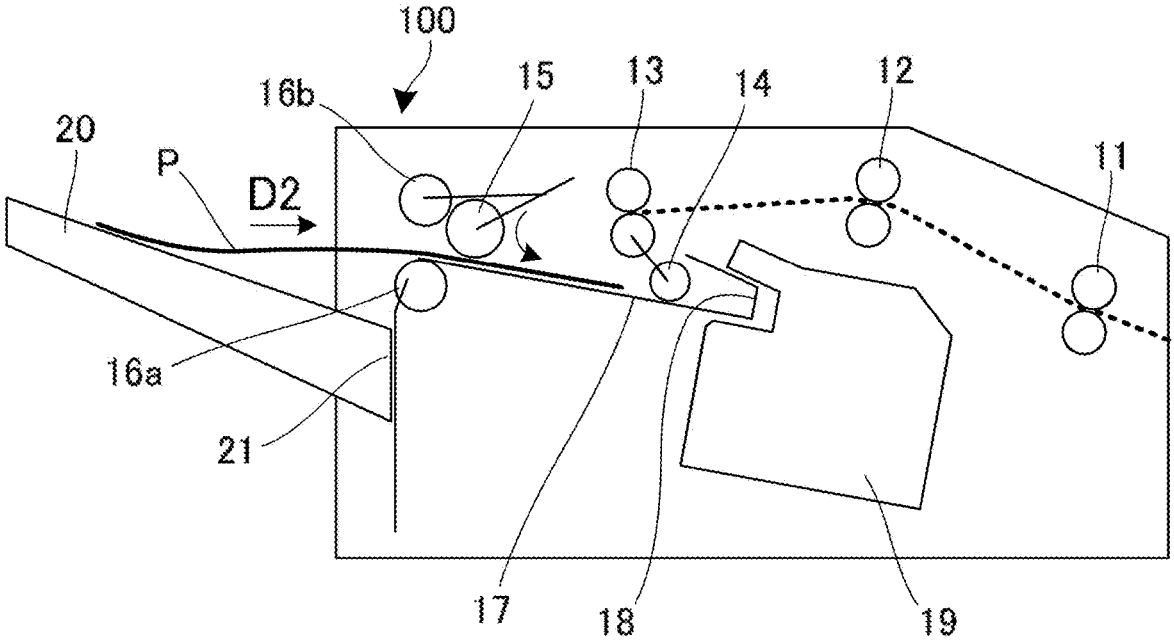

As illustrated in FIG. 5C, after the sheet P is ejected onto the staple tray 17 by the shift rollers 13, the sheet P is tapped and switched back toward the reference fence 18 by the tapping roller 15.

Figure 5D:
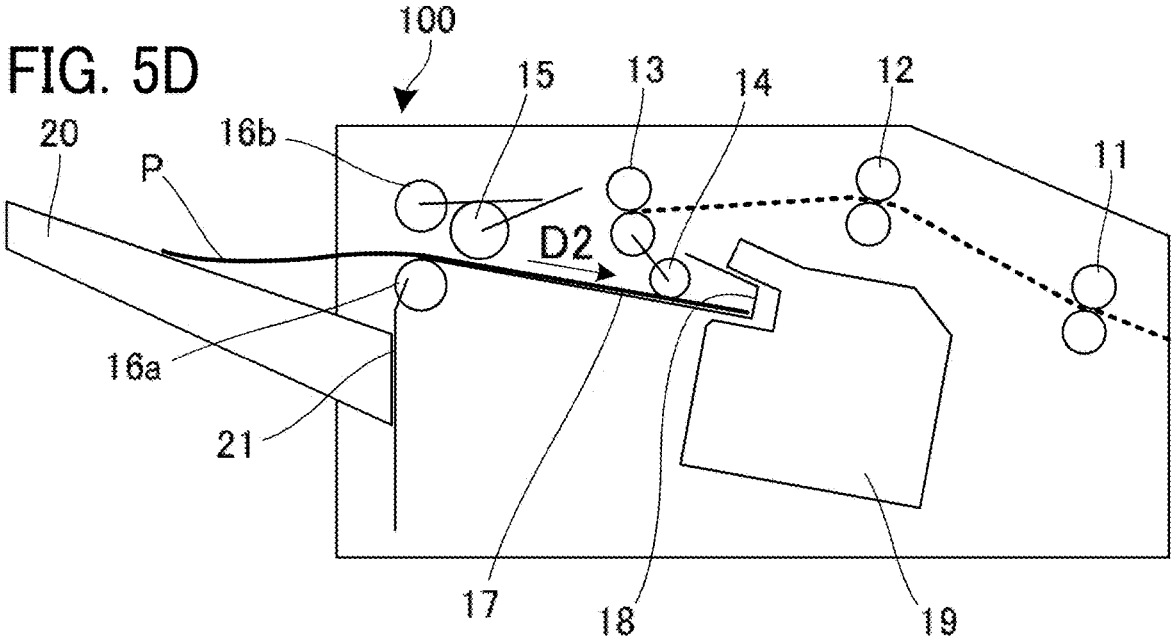

As illustrated in FIG. 5D, the sheet P is conveyed by the tapping roller 15 and the return rollers 14 until the end of the sheet P abuts against the reference fence 18.

The widthwise edges of the sheet P that has abutted against the reference fence 18 are aligned by the pair of jogger fences 22 (jogger fences 22*a* and 22*b*) illustrated in FIG. 4A.

The first sheet P waits, in the state illustrated in FIG. 5D, for the subsequent sheet P to be conveyed as described above with reference to FIGS. 5A to 5D.

Figure 5E:
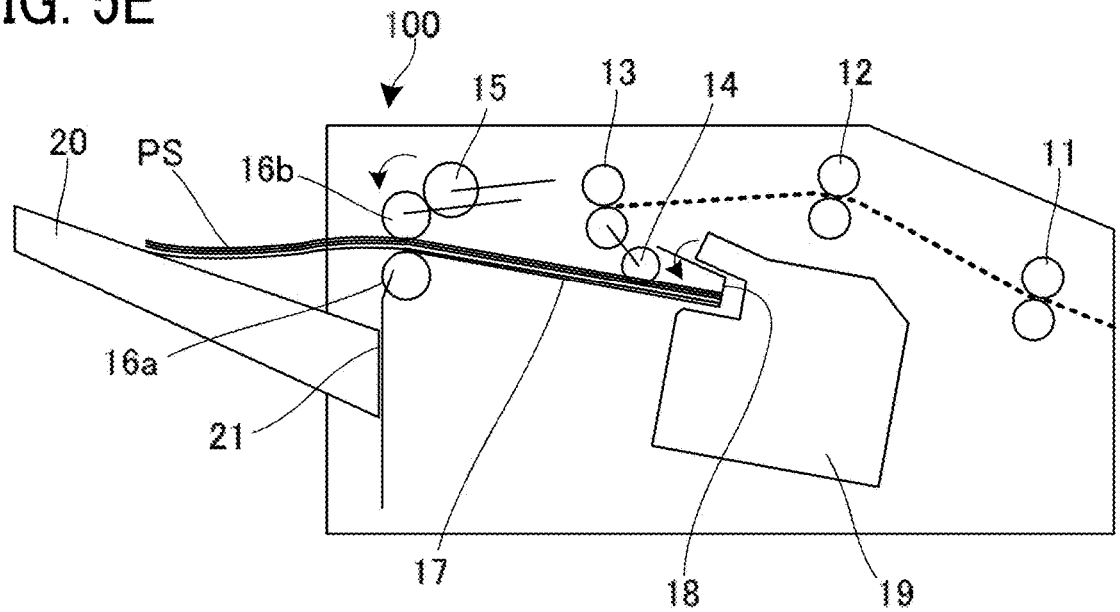

As illustrated in FIG. 5E, the sheets P are sequentially stacked on the staple tray 17 as an aligned sheet bundle PS. The binding device 19 binds the sheet bundle PS. The binding device 19, which is a stapler with staples, drives staples into predetermined points on the sheet bundle PS to bind the sheet bundle PS. The output driven roller 16*b* moves to a nip position.

Figure 5F:
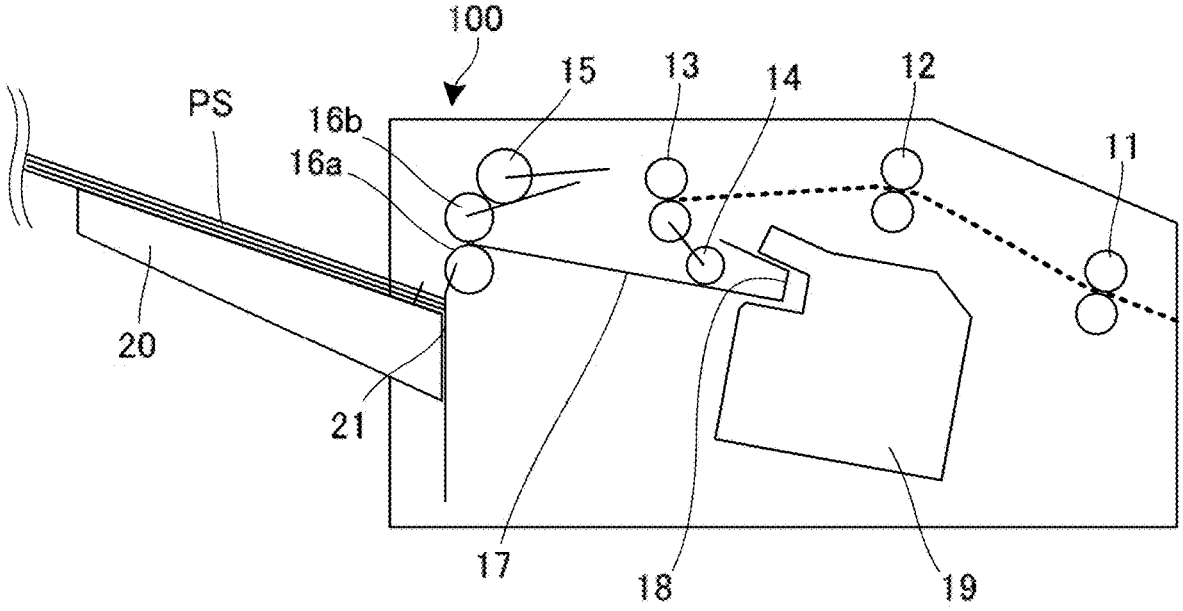

The bound sheet bundle PS is ejected onto the output tray 20 by the output rollers 16 as illustrated in FIG. 5F.

The post-processing apparatus 100 may include a plurality of binding means as a plurality of processing means.

Figure 6:
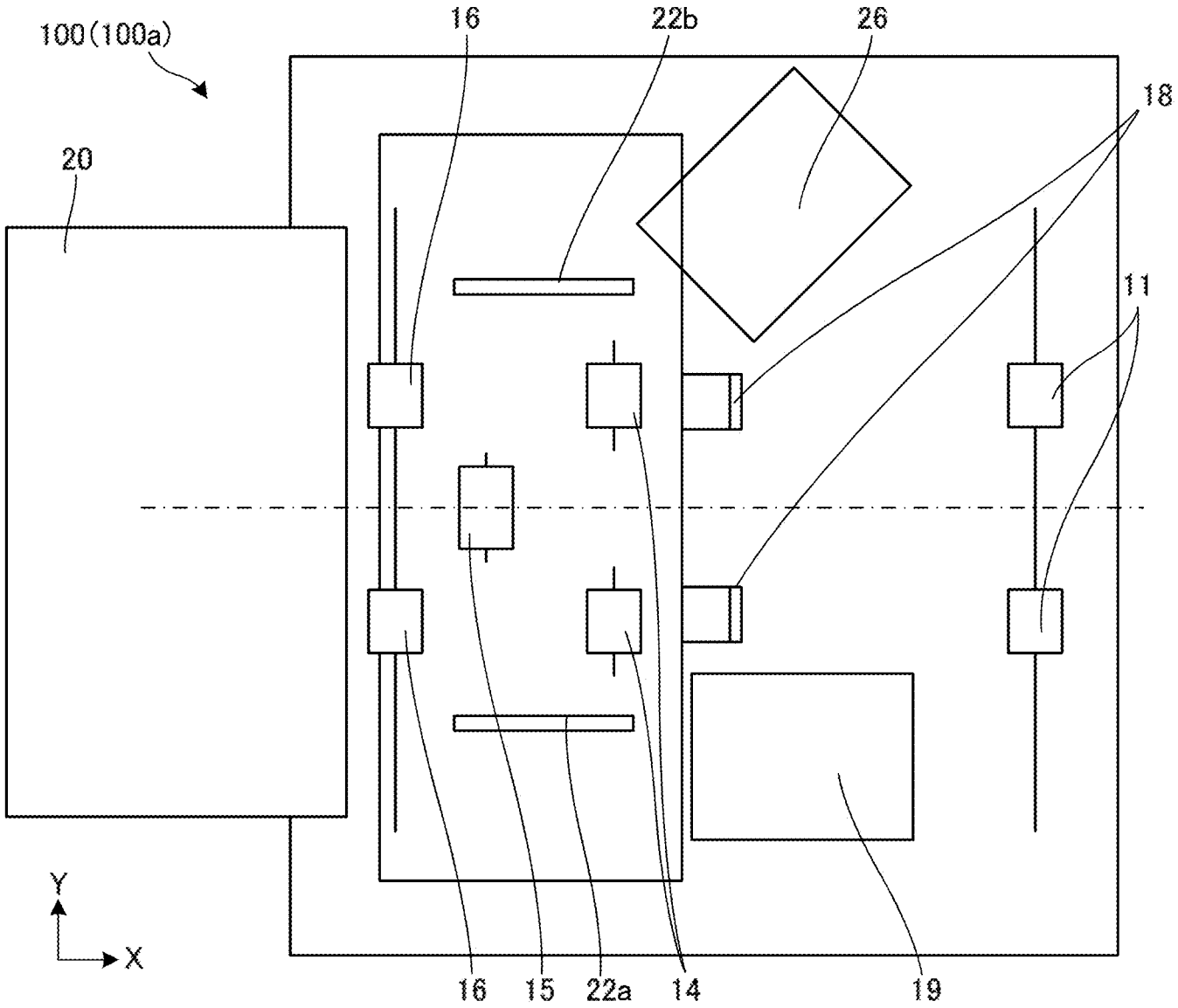
FIG. 6 is a plan view of a medium processing apparatus according to an embodiment of the present disclosure.

FIG. 6 is a plan view of the post-processing apparatus 100 (main device 100*a*) according to the present embodiment. The post-processing apparatus 100 illustrated in FIG. 6 includes, as the binding means, a staple-containing binding device 19 (stapler with staples) that performs binding with staples and a staple-free binding device 26 (stapler without staples) that performs binding without staples.

In the post-processing apparatus 100 illustrated in FIG. 6, the staple-free binding device 26 that performs binding without staples is disposed opposite the position at which the staple-containing binding device 19 is arranged, across the reference line in the direction Y. The relative positions of the staple-containing binding device 19 and the staple-free binding device 26 are not limited to those illustrated in FIG. 6. Alternatively, for example, the staple-free binding device 26 may be disposed at the position of the staple-containing binding device 19 illustrated in FIG. 6, whereas the staple-containing binding device 19 may be disposed at the position of the staple-free binding device 26 illustrated in FIG. 6.

In the post-processing apparatus 100 illustrated in FIG. 6, either the staple-containing binding device 19 or the staple-free binding device 26 performs binding in the staple mode as described above with reference to FIGS. 5A to 5F.

Figure 7A:
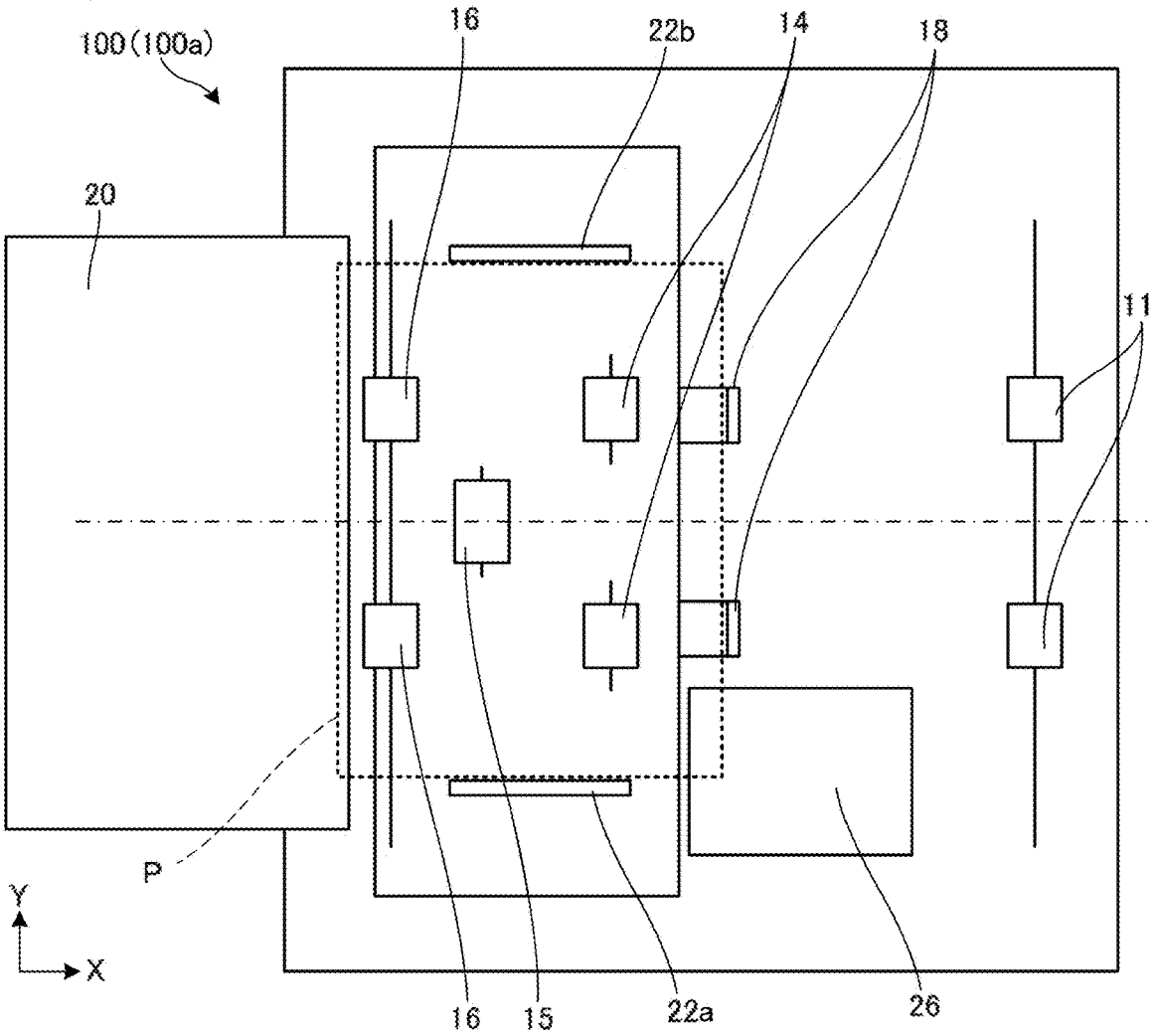
FIG. 7A is a plan view of a medium processing apparatus according to an embodiment of the present disclosure.
Figure 7B:
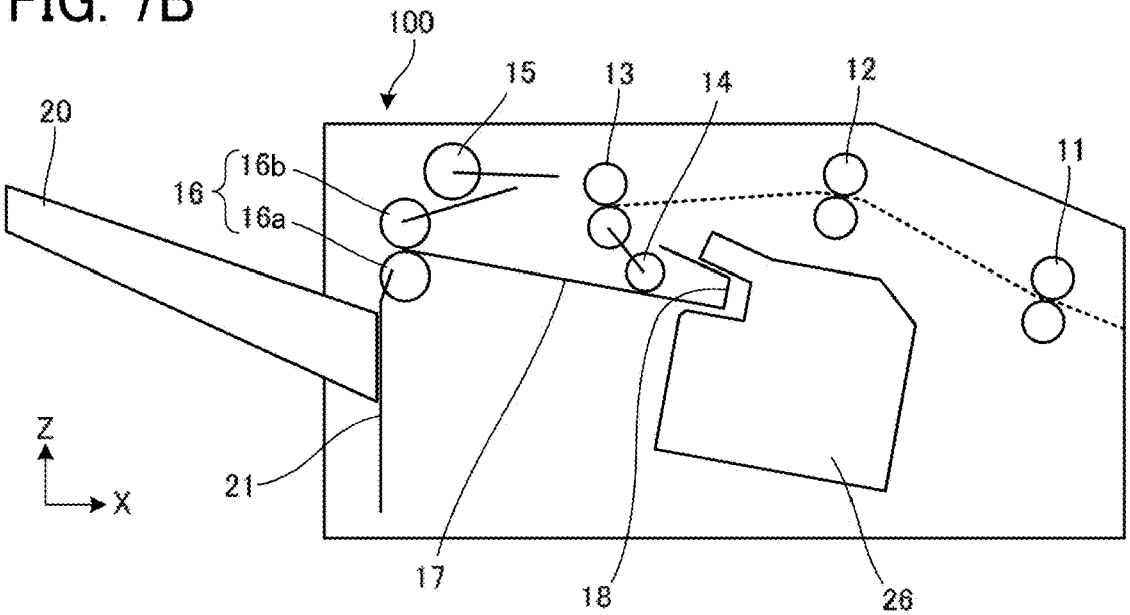
FIG. 7B is a side view of the medium processing apparatus of FIG. 7A.

Each of FIGS. 7A and 7B illustrates the post-processing apparatus 100 (main device 100*a*) according to the present embodiment. The post-processing apparatus 100 illustrated in FIGS. 7A and 7B includes the staple-free binding device 26.

Specifically, FIG. 7A is a plan view of the post-processing apparatus 100. FIG. 7B is a side view of the post-processing apparatus 100 in the direction Y.

In the post-processing apparatus 100 illustrated in FIGS. 7A and 7B, the staple-free binding device 26 performs binding in the staple mode as described above with reference to FIGS. 5A to 5F.

Figure 8A:
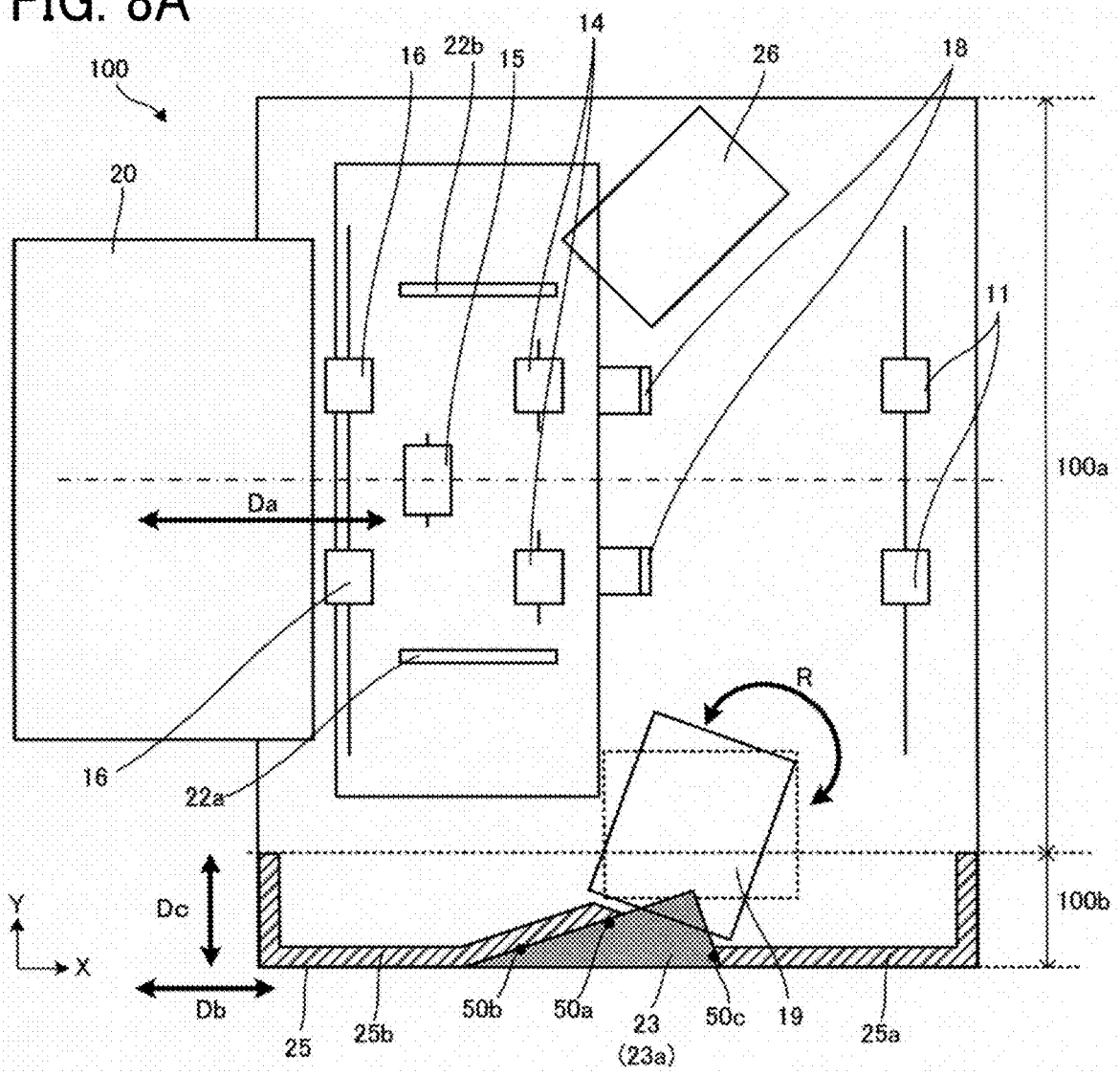
FIG. 8A is a plan view of a medium processing apparatus according to an embodiment of the present disclosure.
Figure 8B:
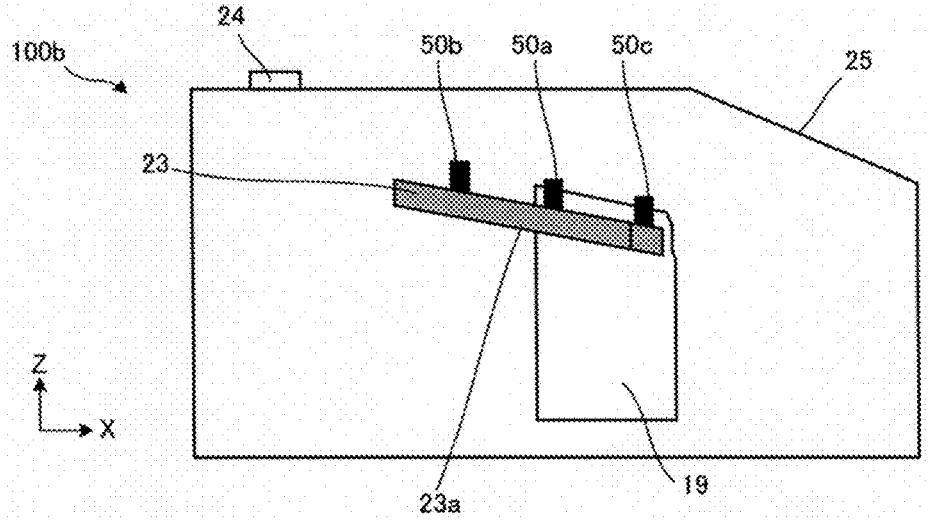
FIG. 8B is a side view of the medium processing apparatus of FIG. 8A.
Figure 9:
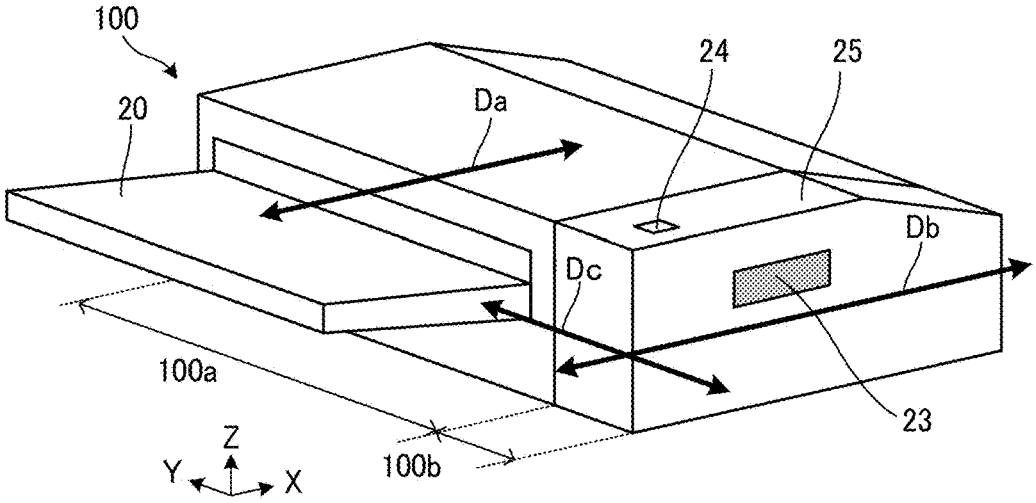
FIG. 9 is an external perspective view of a medium processing device according to an embodiment of the present disclosure.

Each of FIGS. 8A, 8B, and 9 is a diagram illustrating the post-processing apparatus 100 as a medium processing apparatus according to an embodiment of the present disclosure.

Specifically, FIG. 8A is a plan view of the post-processing apparatus 100. FIG. 8B is a side view of the post-processing apparatus 100. FIG. 9 is an external view of the post-processing apparatus 100.

The post-processing apparatus 100 as the medium processing apparatus according to the present embodiment is an apparatus that performs binding as post-processing. The post-processing apparatus 100 includes binding means (binding devices) as post-processing means.

The post-processing apparatus 100 according to the present embodiment includes the main device 100*a*, which performs post-processing on a sheet ejected from the image forming apparatus 300, and a manual processing device 100*b*.

In FIG. 8A, the chain line indicates a reference position (reference line) as the widthwise center of the sheet conveyed in and ejected from the main device 100*a*.

The medium processing apparatus (the post-processing apparatus 100) according to the present embodiment is a medium processing apparatus installed in the image forming apparatus 300. The medium processing apparatus (the post-processing apparatus 100) according to the present embodiment includes a conveyor (conveying means), a slit 23, the medium processing devices 19 and 26 (medium processing means), a plurality of detectors 50 (detecting means) that includes detectors 50*a*, 50*b*, and 50*c*, and stoppers 25*a* and 25*b*. The conveyor conveys a medium ejected from the image forming apparatus 300. The slit 23 communicates with an opening of a housing 25 into which a medium is manually inserted from the outside. The slit 23 includes a placement face 23*a* on which the inserted medium is placed. The medium processing devices 19 and 26 process the medium conveyed by the conveyor and the medium placed on the slit 23. The detectors 50 (detectors 50*a*, 50*b*, and 50*c*) detect the medium. The placement face 23*a* is defined by a first side and a second side orthogonal to the first side. The first side and the second side of the placement face 23*a* are not parallel to directions Db and De in which the side faces of the housing 25 extend. The stoppers 25*a* and 25*b* regulate the edges of the medium along the first side and the second side of the placement face 23*a*. The detectors 50 are disposed on the stoppers 25*a* and 25*b*.

The medium processing apparatus (the post-processing apparatus 100) according to the present embodiment is a medium processing apparatus installed in the image forming apparatus 300. The medium processing apparatus (the post-processing apparatus 100) according to the present embodiment includes a conveyor (conveying means), the slit 23, the medium processing devices 19 and 26 (medium processing means), the detectors 50 (detecting means) that includes the detectors 50*a*, 50*b*, and 50*c*, and the stoppers 25*a* and 25*b*. The conveyor conveys a medium ejected from the image forming apparatus 300. The slit 23 communicates with the opening of the housing 25 into which a medium is manually inserted from the outside. The slit 23 includes the placement face 23*a* on which the inserted medium is placed. The medium processing devices 19 and 26 process the medium conveyed by the conveyor and the medium placed on the slit 23. The detectors 50 (detectors 50*a*, 50*b*, and 50*c*) detect the medium. The placement face 23*a* is defined by a first side and a second side orthogonal to the first side. The first side and the second side of the placement face 23*a* are not parallel to a direction Da in which the conveyor conveys the medium. The stoppers 25*a* and 25*b* regulate the edges of the medium along the first side and the second side of the placement face 23*a*. The detectors 50 are disposed on the stoppers 25*a* and 25*b*.

The post-processing apparatus 100 as the medium processing apparatus illustrated in FIGS. 8A and 8B includes, as the medium processing means, the staple-containing binding device 19 and the staple-free binding device 26 that bind media.

The medium processing means provided with a rotation mechanism can be rotated in a direction R as illustrated in FIG. 8A to change the orientation of the medium processing means.

As illustrated in FIG. 8A, the manual processing device 100*b* includes the first stopper 25*a* and the second stopper 25*b*. The first stopper 25*a* regulates a first edge of a rectangular medium, such as a sheet of paper, manually inserted into the slit 23. The second stopper 25*b* regulates a second edge orthogonal to the first edge of the rectangular medium.

The first edge of the rectangular medium contacts a stopper (for example, the first stopper 25*a*) that is disposed along the first side of the placement face 23*a*, whereas the second edge of the rectangular medium orthogonal to the first edge contacts a stopper (for example, the second stopper 25*b*) that is disposed along the second side of the placement face 23*a*.

When the rectangular medium such as a sheet of paper is manually inserted into the slit 23 and placed on the placement face 23*a*, the first edge of the rectangular medium is stopped by the first stopper 25*a* whereas the second edge of the rectangular medium is stopped by the second stopper 25*b*. Thus, the recording medium is positioned.

Each of the stoppers 25*a* and 25*b* includes a contact face that contacts the medium. In other words, the contact face is a face against which the medium abuts when the medium is set on the placement face 23*a*. The detectors 50 are disposed on the contact faces of the stoppers 25*a* and 25*b*.

The detectors 50 may be sensors (for example, photosensors) that can detect contact with the medium.

The medium processing apparatus according to the present embodiment preferably includes a placement detector (placement detecting means) to detect that a medium is placed on the placement face 23*a*. The sensors are preferably insensitive to contact with, for example, foreign matter other than the medium or a finger of a user. The medium processing apparatus according to the present embodiment preferably performs control such that the medium can be processed only when the placement of the medium is detected.

For example, the medium processing apparatus is allowed to bind media such as sheets of paper only when the placement of the media on the placement face 23*a* is detected, to enhance the safety of the user.

In the example illustrated in FIG. 8B, the slit 23 is inclined at a predetermined angle with respect to the horizontal direction so that the medium is placed on substantially the same plane as the output tray 20. However, the aspect of the slit 23 is not limited to that illustrated in FIG. 8B. Alternatively, for example, the slit 23 may be provided horizontally.

The relative positions of the output tray 20 and the slit 23 are not particularly limited provided that the relative positions allow the binding means to perform both the processing in the main device 100*a* and the processing in the manual processing device 100*b*.

A manual process is started when the user presses a start key 24 illustrated in FIGS. 8B and 9.

The home position (HP) of the processing means may be set to a position at which the manual process is performed. In this case, the manual process can be performed immediately in response to the start key 24 being pressed after the power of the medium processing apparatus is turned on.

The placement face 23*a* of the manual processing device 100*b* of the medium processing apparatus according to the present embodiment is narrower than a placement face shaped such that either the first side or the second side is parallel to the direction Da in which the conveying means conveys media, or a placement face shaped parallel to the directions Db and Dc in which the side faces of the housing 25 extend. In addition, the placement face 23*a* has a smaller area that supports the media placed thereon than the aforementioned placement faces. For this reason, for example, when the sheet bundle is set to be bound, the sheet bundle is likely to be inclined and may be failed to be bound.

To prevent such a binding failure, the medium processing apparatus according to the present embodiment includes a plurality of detecting means to detect whether the inserted medium is appropriately set and perform processing at a correct position.

Referring to FIGS. 10A to 13B, a description is given below of some examples of detection with detecting means.

Each of FIGS. 10A to 13B is a plan view of the manual processing device 100*b*, with sheets (or sheet bundle) P as media placed.

Figure 10A:
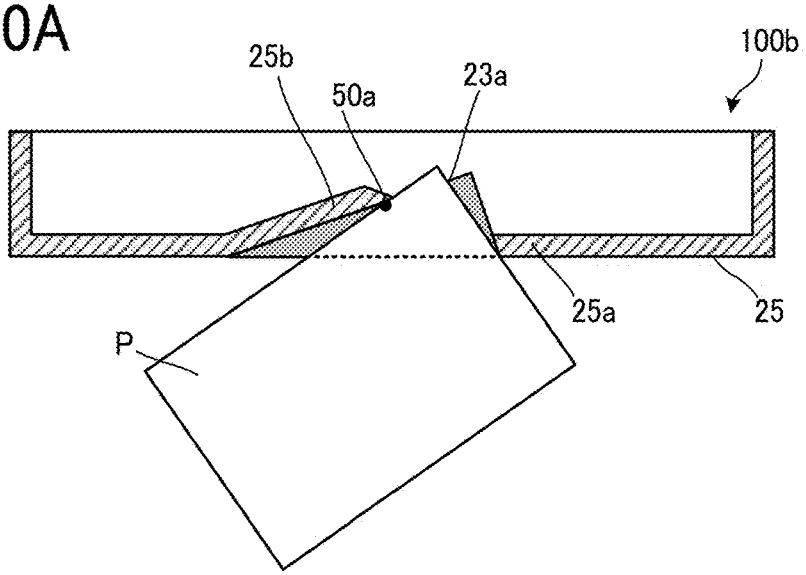
FIG. 10A is a diagram illustrating a first example of the detection of a medium set on a placement face with a detector.

Specifically, each of FIGS. 10A to and 10B illustrates a comparative example in which the detector 50*a* is disposed only at one location on the stopper 25*b*.

Figure 10B:
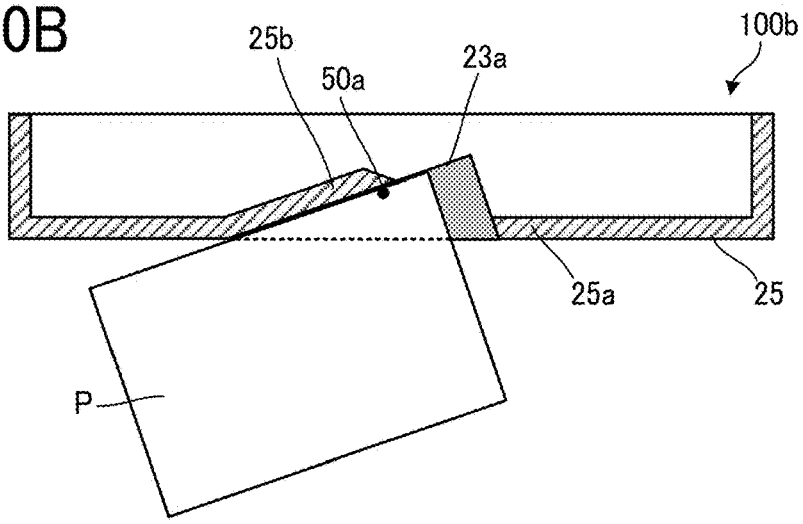
FIG. 10B is a diagram illustrating a second example of the detection of a medium set on the placement face with the detector.

When the detector 50*a* detects the sheets P, the set position of the sheets P may be inappropriate as illustrated in FIG. 10A. As illustrated in FIG. 10B, the medium may contact only the stopper 25*b* disposed along the side of the placement face 23*a* provided with the detector 50*a*, without contacting the stopper 25*a* disposed along the other side of the placement face 23*a*.

When the single detector 50*a* is disposed alone, the processing is executed even when the sheets P are placed as illustrated in FIG. 10A or 10B. In this case, in the processing with the staple-containing binding device 19, staples may remain in the apparatus and cause a failure. In the processing with the staple-free binding device 26, idle driving may reduce the strength of the teeth.

A description is given below of some examples in which two detectors (detecting means) are disposed.

Figure 11A:
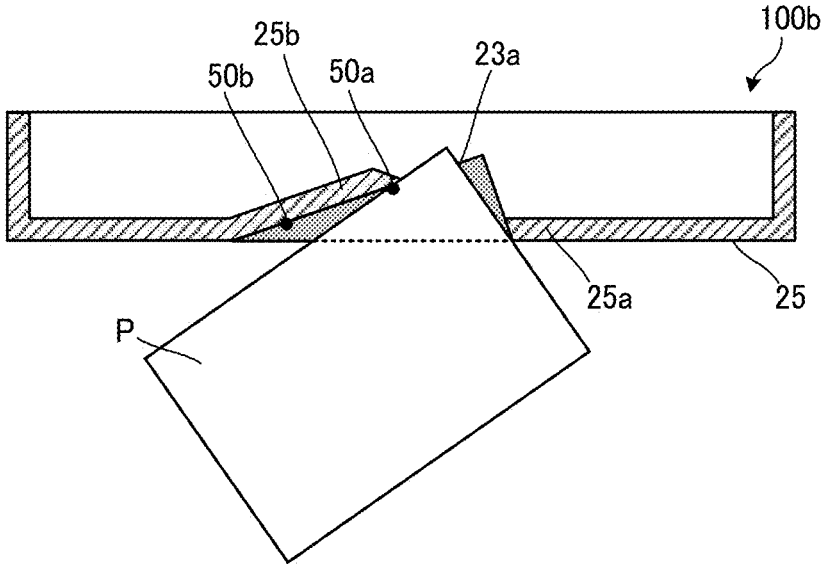
FIG. 11A is a diagram illustrating a first example of the detection of a medium set on a placement face with one of two detectors.
Figure 11B:
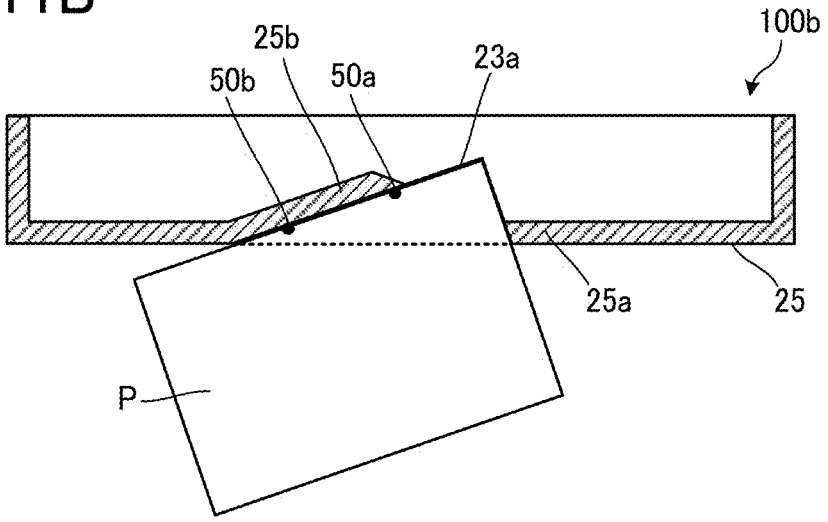
FIG. 11B is a diagram illustrating a second example of the detection of a medium set on a placement face with the two detectors.
Figure 12A:
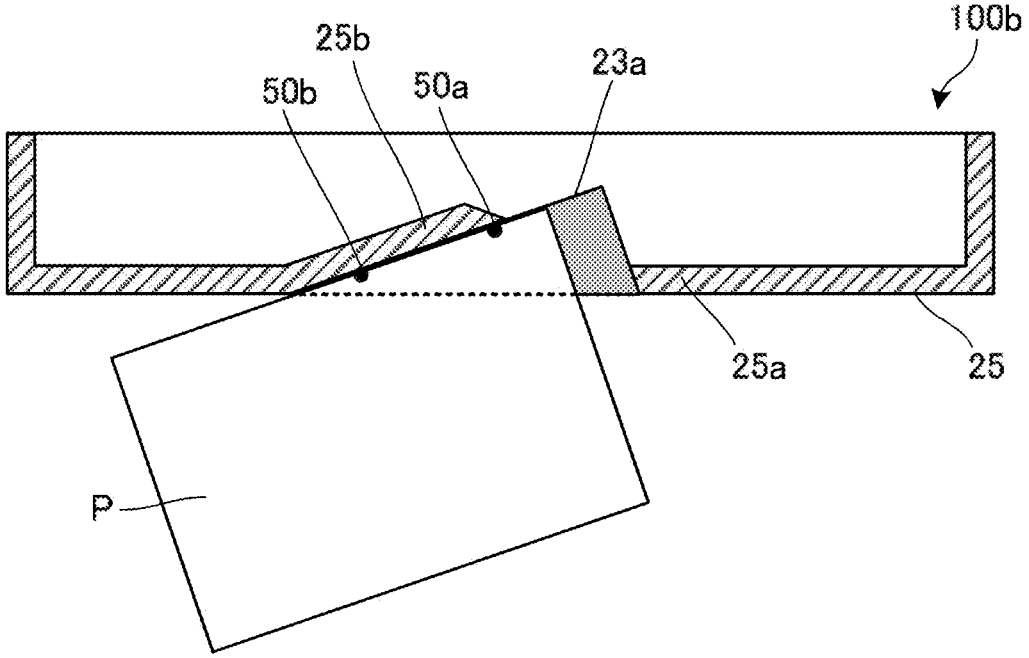
FIG. 12A is a diagram illustrating a first example of the detection of a medium set on a placement face with two detectors.
Figure 12B:
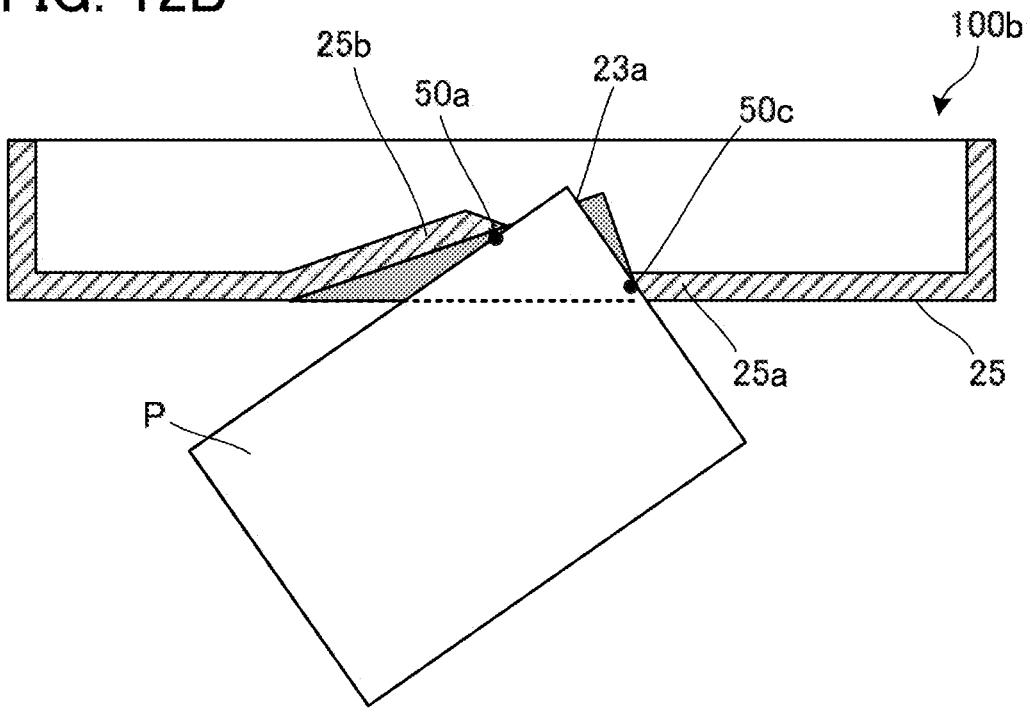
FIG. 12B is a diagram illustrating a second example of the detection of a medium set on a placement face with two detectors.

Each of FIGS. 11A, 11B, and 12A illustrates an example in which the two detectors (detectors 50*a* and 50*b*) are disposed only on the stopper 25*b*. FIG. 12B illustrates an example in which one of the two detectors (detector 50*a*) is disposed on the stopper 25*b* and the other detector (detector 50*c*) is disposed on the stopper 25*a*.

As illustrated in FIG. 11A, the sheets P placed in an inclined state are detected by only one detector (detector 50*a*) and are not detected by the other detector (detector 50*b*). Thus, the medium processing apparatus detects that the sheets P are not appropriately set. In this case, the user may be notified of a warning.

On the other hand, as illustrated in FIG. 11B, the sheets P placed at the correct position are detected by the detectors 50*a* and 50*b*. Thus, the medium processing apparatus detects that the sheets P are appropriately set.

However, even when the medium processing apparatus includes two detectors, the medium process apparatus may erroneously detect that the sheets P are appropriately set. For example, when the detectors 50*a* and 50*b* detect the medium that is incorrectly placed as illustrated in FIG. 12A, the medium processing apparatus may erroneously detect that the sheets P are appropriately set.

Alternatively, when the detectors 50*c* and 50*a* disposed on the two stoppers 25*a* and 25*b*, respectively detect the sheets P that are incorrectly placed as illustrated in FIG. 12B, the medium processing apparatus may erroneously detect that the sheets P are appropriately set.

To prevent such erroneous detection, an increased number of detectors (detecting means) may be disposed at an increased number of locations.

A description is given below of an example in which three detectors (detecting means) are disposed.

Figure 13A:
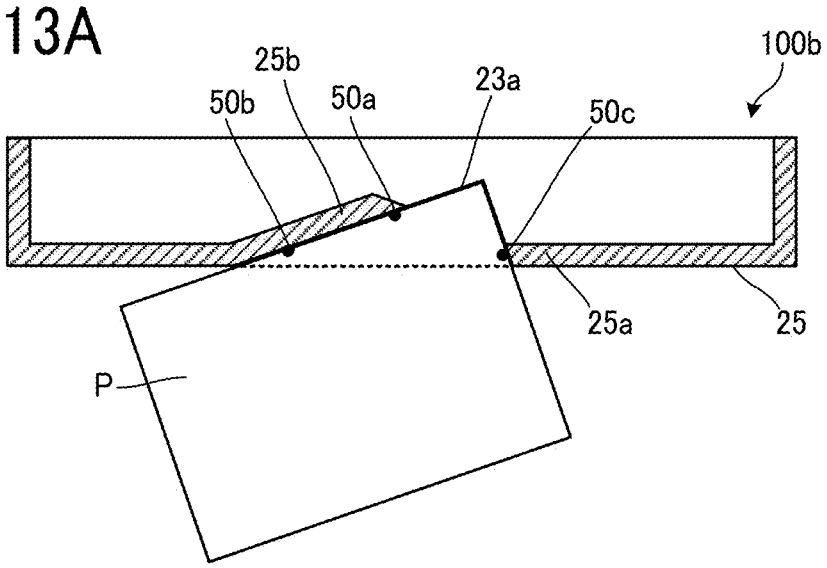
FIG. 13A is a diagram illustrating a first example of the detection of a medium set on a placement face with three detectors.
Figure 13B:
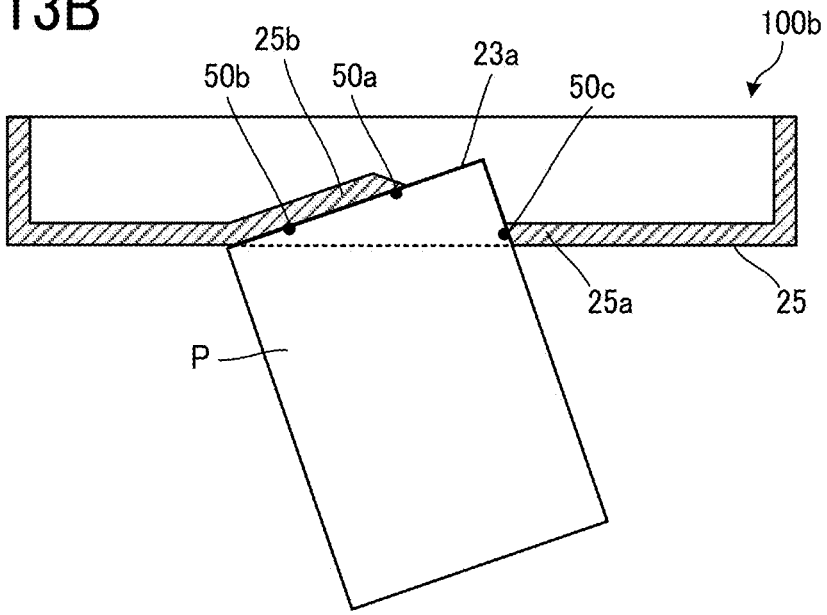
FIG. 13B is a diagram illustrating a second example of the detection of a medium set on the placement face with the three detectors.

Each of FIGS. 13A and 13B illustrates an example in which two of the three detectors (detectors 50*a* and 50*b*) are disposed on the stopper 25*b* whereas one of the three detectors (detector 50*c*) is disposed on the stopper 25*a*.

As illustrated in FIGS. 13A and 13B, the sheets P placed at the correct position are detected by the detectors 50*a*, 50*b*, and 50*c*. Thus, the medium processing apparatus detects that the sheets P are appropriately set. Regardless of the orientation of the sheets P, the medium processing apparatus can detect the sheets P.

As described above, when the first side and the second side of the placement face 23*a* have different lengths, the detectors 50 (detecting means) are disposed at: at least two locations on the stopper 25*b* that is disposed along a longer one of the first side and the second side, and at least one location on the stopper 25*a* that is disposed along a shorter one of the first side and the second side.

The way in which the detectors are disposed is not limited to the above example. Alternatively, for example, three or more detectors 50 (detecting means) may be disposed at three or more locations.

Figure 14A:
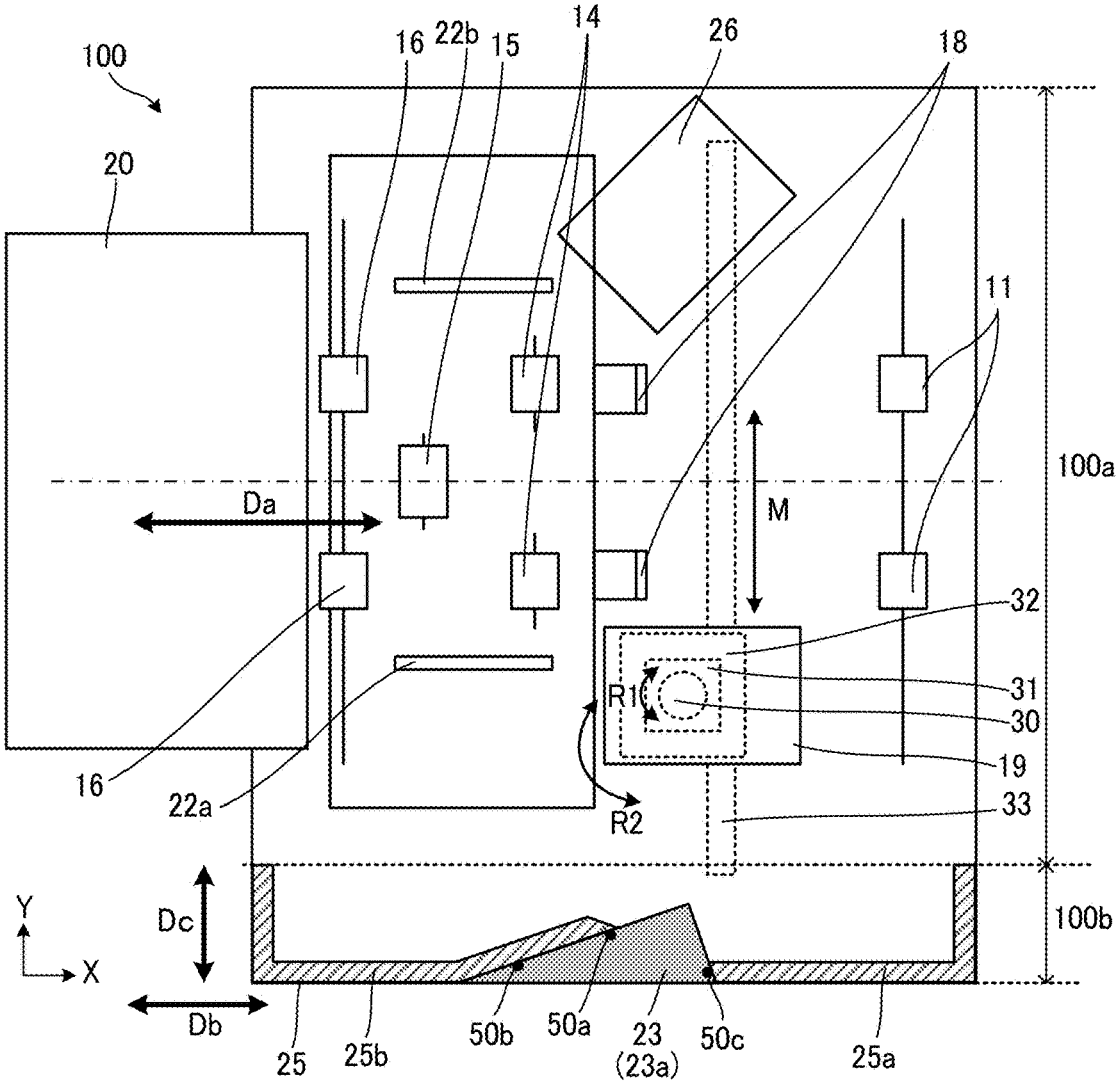
FIG. 14A is a plan view of a medium processing apparatus according to an embodiment of the present disclosure.
Figure 14B:
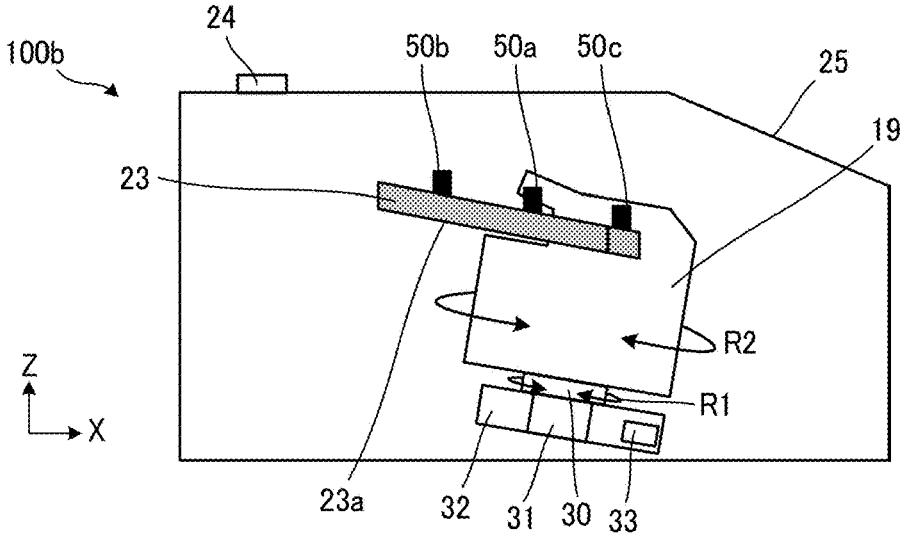
FIG. 14B is a side view of the medium processing apparatus of FIG. 14A.

Each of FIGS. 14A and 14B is a diagram illustrating the post-processing apparatus 100 as a medium processing apparatus according to an embodiment of the present disclosure. Specifically, FIG. 14A is a plan view of the post-processing apparatus 100. FIG. 14B is a side view of the manual processing device 100*b*.

The post-processing apparatus 100 as the medium processing apparatus according to the present embodiment is an apparatus that performs binding as post-processing. The post-processing apparatus 100 includes binding means (binding devices) as post-processing means.

The post-processing apparatus 100 according to the present embodiment includes the main device 100*a*, which performs post-processing on a sheet ejected from the image forming apparatus 300, and a manual processing device 100*b*.

In FIG. 14A, the chain line indicates a reference position (reference line) as the widthwise center of the sheet conveyed in and ejected from the main device 100*a*.

The medium processing apparatus according to the present embodiment includes a rotating unit (rotating means) and a control unit (control means). The rotating unit rotates the medium processing means in the horizontal direction. The control unit controls the amount of rotation of the rotating unit.

In the example illustrated in FIGS. 14A and 14B, the binding device as the medium processing means is provided with the rotating means.

The rotating means includes a rotator 31 such as a drive motor and a movable part 30 that is connected to the rotator 31 and the staple-containing binding device 19. As the rotator 31 rotates in directions indicated by double-headed arrow R1 in FIGS. 14A and 14B, the staple-containing binding device 19 horizontally rotates in directions indicated by double-headed arrow R2 in FIGS. 14A and 14B.

The staple-free binding device 26 has a configuration like the configuration described above.

The control means controls the direction and amount of rotation of the rotating means.

Such control enables desired processing such as oblique binding or horizontal binding. In the oblique binding, the medium processing apparatus binds the media obliquely with respect to the edge of the media. In the horizontal binding, the medium processing apparatus binds the media horizontally with respect to the edge of the media.

The medium processing apparatus according to the present embodiment includes a movable member 33 that enables the medium processing means to reciprocate in directions indicated by double-headed arrow M in FIG. 14A. The staple-containing binding device 19 is attached to the movable member 33 through a fixed part 32 as illustrated in FIG. 14B. The staple-free binding device 26 has a configuration like the configuration described above.

The control means controls the direction and amount of movement of the movable member 33.

Thus, the processing means can be moved to and disposed at a desired processing position.

Figure 15:
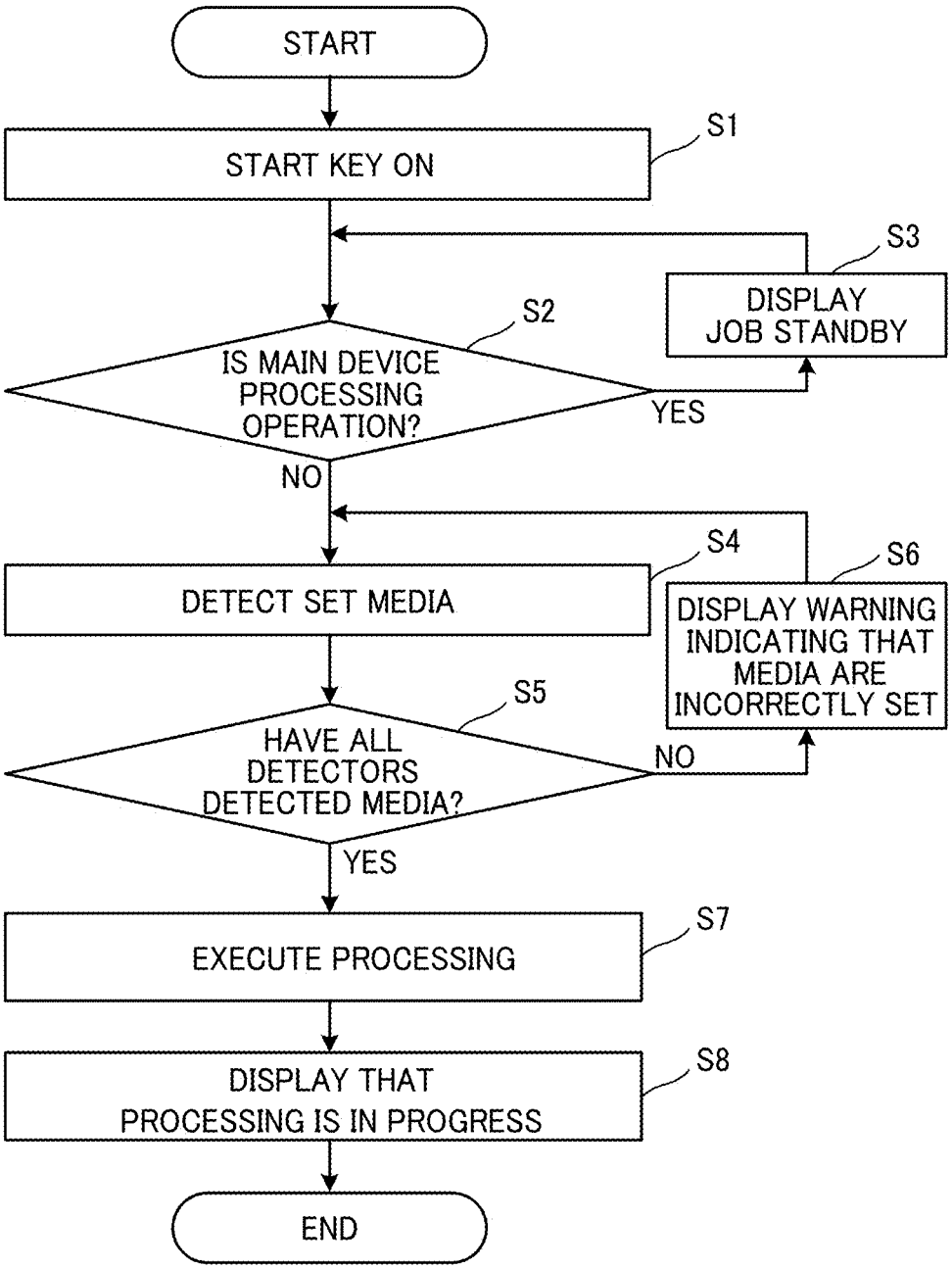
FIG. 15 is a flowchart of a manual process according to an embodiment of the present disclosure.

FIG. 15 is a flowchart of a manual process in the medium processing apparatus according to the present embodiment.

The manual process starts when a user presses the start key 24.

In step S1, the start key 24 is turned on. In step S2, the control unit 306 determines whether the main device 100*a* is in the processing operation (for example, in the staple mode). When the main device 100*a* is in the processing operation (YES in step S2), in step S3, the control unit 306 displays an instruction of job standby on the operation panel 310 to notify the user of the instruction.

FIG. 16A illustrates an image displayed on the operation panel 310 at this time, according to the present embodiment.

When the main device 100*a* is not in the processing operation (NO in step S2), the manual process is executed.

In step S4, the detectors 50 detect the set media.

The medium processing apparatus according to the present embodiment includes the multiple detectors 50 (detecting means). In step S5, the CPU 102*a* determines whether the media are appropriately set, depending on whether all of the detectors 50 have detected the media as illustrated in, for example, FIGS. 13A and 13B.

When any of the detectors 50 (for example, any one or two of three detectors disposed at three locations) has not detected the media (NO in step S5), the CPU 102*a* determines that the media are inappropriately set. In step S6, the control unit 306 displays, on the operation panel 310, a warning that the media are inappropriately set.

FIG. 16B illustrates an image displayed on the operation panel 310 at this time, according to the present embodiment.

The user who has confirmed the warning displayed can correct the setting of the media.

After the user sets the media again, in step S4, the detectors 50 detect the media again. This flow is repeated until the media are appropriately set.

When all of the detectors 50 have detected the media (YES in step S5), the CPU 102*a* determines that the media are appropriately set. In step S7, the CPU 102*a* executes processing. In step S8, the control unit 306 displays, on the operation panel 310, a message indicating that the processing is in progress.

FIG. 16C illustrates an image displayed on the operation panel 310 at this time, according to the present embodiment.

Although the aspect has been described above in which the post-processing apparatus as the medium processing apparatus according to the present embodiment performs binding, the configuration according to the embodiments of the present disclosure can also be applied to a medium processing apparatus that performs post-processing other than binding.

A description is now given of some aspects of the present disclosure.

According to a first aspect, a medium processing apparatus to be installed in an image forming apparatus includes conveying means, a slit, medium processing means, a plurality of detecting means, and a stopper. The conveying means conveys a medium ejected from the image forming apparatus. The slit communicates with an opening of a housing into which a medium is manually inserted from the outside. The slit includes a placement face on which the inserted medium is placed. The medium processing means processes the medium conveyed by the conveying means or the medium placed on the slit. The detecting means detect the medium. The placement face has a first side and a second side orthogonal to the first side. The first side and the second side are not parallel to a direction in which a side face of the housing extends. The stopper regulates edges of the medium along the first side and the second side of the placement face. The detecting means are disposed on the stopper.

According to a second aspect, a medium processing apparatus to be installed in an image forming apparatus includes conveying means, a slit, medium processing means, a plurality of detecting means, and a stopper. The conveying means conveys a medium ejected from the image forming apparatus. The slit communicates with an opening of a housing into which a medium is manually inserted from the outside. The slit includes a placement face on which the inserted medium is placed. The medium processing means processes the medium conveyed by the conveying means or the medium placed on the slit. The detecting means detect the medium. The placement face has a first side and a second side orthogonal to the first side. The first side and the second side of the placement face are not parallel to a direction in which the conveying means conveys the medium. The stopper regulates edges of the medium along the first side and the second side of the placement face. The detecting means are disposed on the stopper.

According to a third aspect, the medium processing apparatus of the first or second aspect, further includes rotating means and control means. The rotating means rotates the medium processing means in a horizontal direction. The control means controls an amount of rotation of the rotating means.

According to a fourth aspect, in the medium processing apparatus of any one of the first to third aspects, the medium is a rectangular medium and includes a first edge and a second edge orthogonal to the first edge. The first edge of the rectangular medium contacts the stopper disposed along the first side. The second edge of the rectangular medium contacts the stopper disposed along the second side.

According to a fifth aspect, in the medium processing apparatus according to any one of the first to fourth aspects, the detecting means include placement detecting means to detect that the medium is placed on the placement face.

According to a sixth aspect, in the medium processing apparatus of any one of the first to fifth aspects, the placement face has a first side and a second side of different lengths. The detecting means are disposed at: at least two locations on the stopper disposed along a longer one of the first side and the second side, and at least one location on the stopper disposed along a shorter one of the first side and the second side.

According to a seventh aspect, an image forming system includes an image forming apparatus that forms an image on a medium and the medium processing apparatus according to any one of the first to sixth aspects. The medium processing apparatus performs post-processing on the medium on which the image is formed by the image forming unit.

According to one or more aspects of the present disclosure, the medium processing apparatus detects whether an inserted medium is appropriately set and performs processing at the correct position.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A medium processing apparatus for processing a medium ejected from an image forming apparatus, the medium processing apparatus comprising:

a conveyor to convey the medium ejected from the image forming apparatus;

a slit communicating with an opening of a housing into which a medium is manually inserted from outside, the slit including a placement face on which the inserted medium is placed, the placement face having a first side and a second side orthogonal to the first side, the first side and the second side being not parallel to a direction in which a side face of the housing extends;

a medium processing device to process the medium conveyed by the conveyor or the medium placed on the slit;

a stopper to regulate edges of the medium along the first side and the second side of the placement face;

a plurality of detectors disposed on the stopper to detect the medium;

a rotating unit to rotate the medium processing device in a horizontal direction; and circuitry configured to control an amount of rotation of the rotating unit.

2. The medium processing apparatus according to claim 1, wherein the medium processing device comprises a binding device.

3. The medium processing apparatus according to claim 1, wherein the medium is a rectangular medium and includes a first edge and a second edge orthogonal to the first edge, wherein the first edge of the rectangular medium contacts the stopper disposed along the first side, and wherein the second edge of the rectangular medium contacts the stopper disposed along the second side.

4. The medium processing apparatus according to claim 1, wherein the plurality of detectors includes a placement detector to detect that the medium is placed on the placement face.

5. The medium processing apparatus according to claim 1, wherein the placement face has the first side and the second side of different lengths, and wherein the plurality of detectors are disposed at:

at least two locations on the stopper disposed along a longer one of the first side and the second side; and at least one location on the stopper disposed along a shorter one of the first side and the second side.

6. An image forming system comprising:

the image forming apparatus to form an image on the medium; and the medium processing apparatus according to claim 1, to perform post-processing on the medium on which the image is formed by the image forming apparatus.

7. A medium processing apparatus for processing a medium ejected from an image forming apparatus, the medium processing apparatus comprising:

a conveyor to convey the medium ejected from the image forming apparatus;

a slit communicating with an opening of a housing into which a medium is manually inserted from outside, the slit including a placement face on which the inserted medium is placed, the placement face having a first side and a second side orthogonal to the first side, the first side and the second side being not parallel to a direction in which the conveyor conveys the medium;

a medium processing device to process the medium conveyed by the conveyor or the medium placed on the slit;

a stopper to regulate edges of the medium along the first side and the second side of the placement face;

a plurality of detectors disposed on the stopper to detect the medium;

a rotating unit to rotate the medium processing device in a horizontal direction; and circuitry configured to control an amount of rotation of the rotating unit.

8. The medium processing apparatus according to claim 7, wherein:

the medium processing device comprises a binding device.

9. The medium processing apparatus according to claim 7, wherein the medium is a rectangular medium and includes a first edge and a second edge orthogonal to the first edge, wherein the first edge of the rectangular medium contacts the stopper disposed along the first side, and wherein the second edge of the rectangular medium contacts the stopper disposed along the second side.

10. The medium processing apparatus according to claim 7, wherein the plurality of detectors includes a placement detector to detect that the medium is placed on the placement face.

11. The medium processing apparatus according to claim 7, wherein the placement face has the first side and the second side of different lengths, and wherein the plurality of detectors are disposed at:

at least two locations on the stopper disposed along a longer one of the first side and the second side; and at least one location on the stopper disposed along a shorter one of the first side and the second side.

12. An image forming system comprising:

the image forming apparatus to form an image on the medium; and the medium processing apparatus according to claim 7, to perform post-processing on the medium on which the image is formed by the image forming apparatus.

13. A medium processing apparatus for processing a medium ejected from an image forming apparatus, the medium processing apparatus comprising:

a conveyor to convey the medium ejected from the image forming apparatus;

a slit communicating with an opening of a housing into which a medium is manually inserted from outside, the slit including a placement face on which the inserted medium is placed, the placement face having a first side and a second side orthogonal to the first side, the first side and the second side being not parallel to a direction in which a side face of the housing extends;

a medium processing device to process the medium conveyed by the conveyor or the medium placed on the slit;

a stopper to regulate edges of the medium along the first side and the second side of the placement face; and a plurality of detectors disposed on the stopper to detect the medium, wherein the placement face has the first side and the second side of different lengths, and wherein the plurality of detectors are disposed at:

at least two locations on the stopper disposed along a longer one of the first side and the second side; and at least one location on the stopper disposed along a shorter one of the first side and the second side.

14. The medium processing apparatus according to claim 13, wherein:

the medium processing device comprises a binding device.

15. An image forming system comprising:

the image forming apparatus to form an image on the medium; and the medium processing apparatus according to claim 13, to perform post-processing on the medium on which the image is formed by the image forming apparatus.

16. A medium processing apparatus for processing a medium ejected from an image forming apparatus, the medium processing apparatus comprising:

a conveyor to convey the medium ejected from the image forming apparatus;

a slit communicating with an opening of a housing into which a medium is manually inserted from outside, the slit including a placement face on which the inserted medium is placed, the placement face having a first side and a second side orthogonal to the first side, the first side and the second side being not parallel to a direction in which the conveyor conveys the medium;

a medium processing device to process the medium conveyed by the conveyor or the medium placed on the slit;

a stopper to regulate edges of the medium along the first side and the second side of the placement face; and a plurality of detectors disposed on the stopper to detect the medium, wherein the placement face has the first side and the second side of different lengths, and wherein the plurality of detectors are disposed at:

at least two locations on the stopper disposed along a longer one of the first side and the second side; and at least one location on the stopper disposed along a shorter one of the first side and the second side.

17. The medium processing apparatus according to claim 16, wherein:

the medium processing device comprises a binding device.

18. An image forming system comprising:

the image forming apparatus to form an image on the medium; and the medium processing apparatus according to claim 16, to perform post-processing on the medium on which the image is formed by the image forming apparatus.

19. The medium processing apparatus according to claim 1, further comprising:

a moveable member to enable the medium processing device to reciprocate in the horizontal direction.

20. The medium processing apparatus according to claim 7, further comprising:

a moveable member to enable the medium processing device to reciprocate in the horizontal direction.

* * * * *